US007648432B1

(12) United States Patent
Hall

(10) Patent No.: US 7,648,432 B1
(45) Date of Patent: Jan. 19, 2010

(54) HOME PLATE WITH UP-TIGHT BEVEL

(76) Inventor: Roger E. Hall, 150 E. Willow St., Elizabethtown, PA (US) 17022-1943

( * ) Notice: Subject to any disclaimer, the term of this patent is extended or adjusted under 35 U.S.C. 154(b) by 193 days.

(21) Appl. No.: 11/967,821

(22) Filed: Dec. 31, 2007

Related U.S. Application Data

(60) Provisional application No. 60/882,725, filed on Dec. 29, 2006.

(51) Int. Cl.
*A63B 71/00* (2006.01)

(52) U.S. Cl. ..... 473/499; 473/501

(58) Field of Classification Search ..... 473/499–501
See application file for complete search history.

(56) References Cited

U.S. PATENT DOCUMENTS

| | | | | |
|---|---|---|---|---|
| 3,508,747 | A * | 4/1970 | Orsatti | 473/499 |
| 3,572,705 | A * | 3/1971 | Wyble | 473/499 |
| 4,266,768 | A * | 5/1981 | Hall | 473/501 |
| 4,448,414 | A * | 5/1984 | Gutierrez | 473/499 |
| 4,531,733 | A * | 7/1985 | Hall | 473/501 |

* cited by examiner

*Primary Examiner*—Mitra Aryanpour
(74) *Attorney, Agent, or Firm*—Miles & Stockbridge P.C.; David R. Schaffer, Esq.

(57) ABSTRACT

This patent application is for a baseball and softball home plate system generally, and more specifically a home plate system with changeable top plate sections and an up-tight bevel.

33 Claims, 14 Drawing Sheets

FIG.1
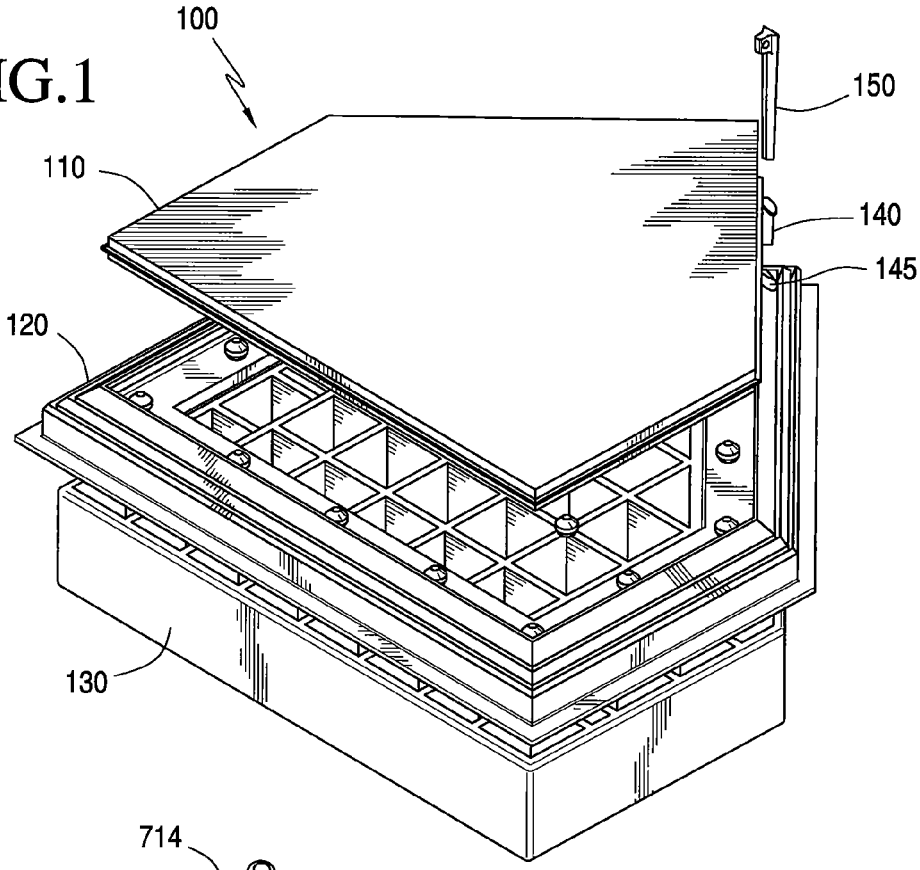
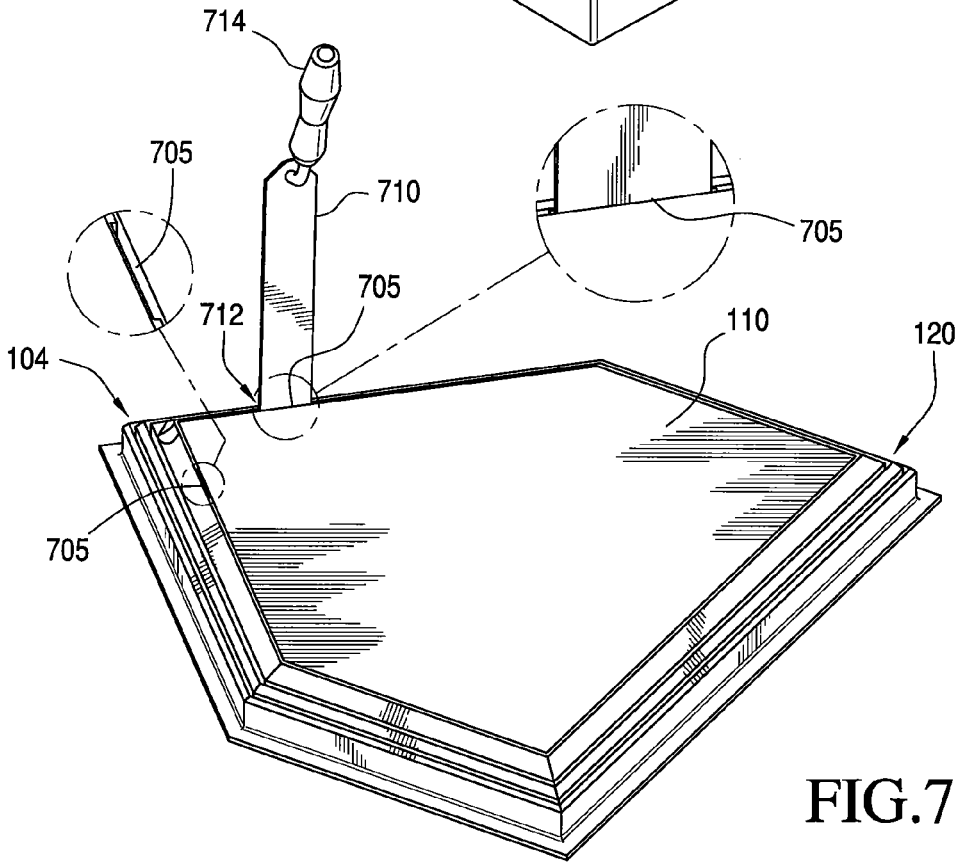
FIG.7

FIG. 8A
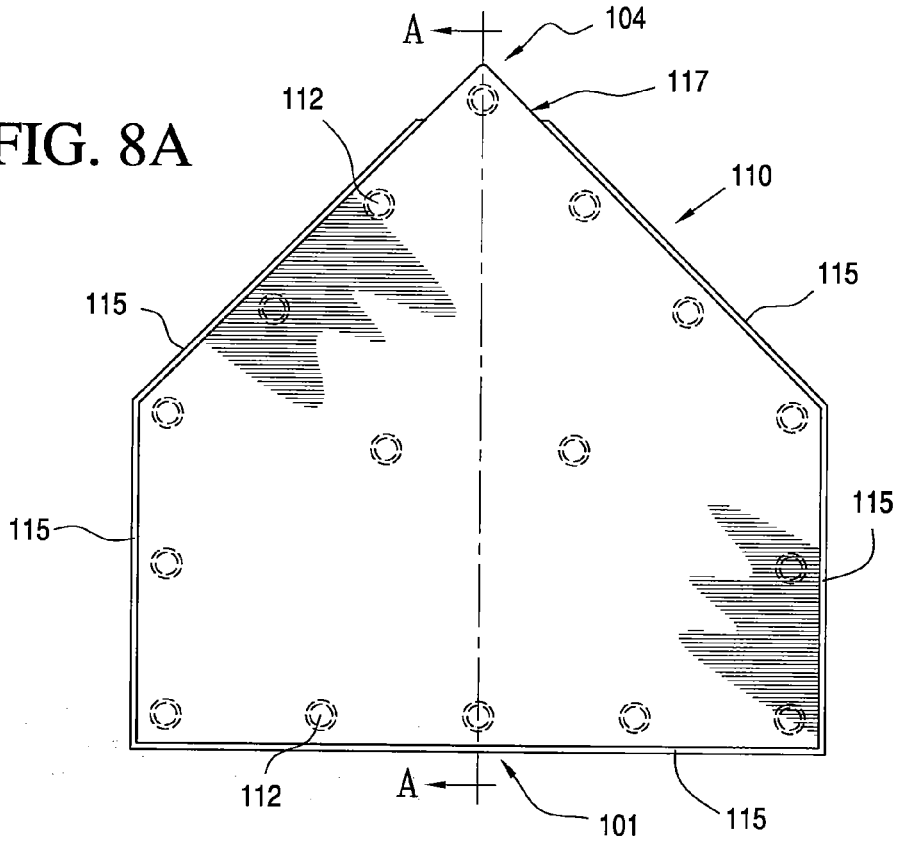
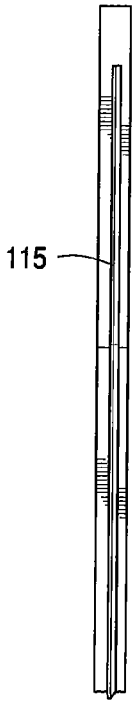
FIG. 8C
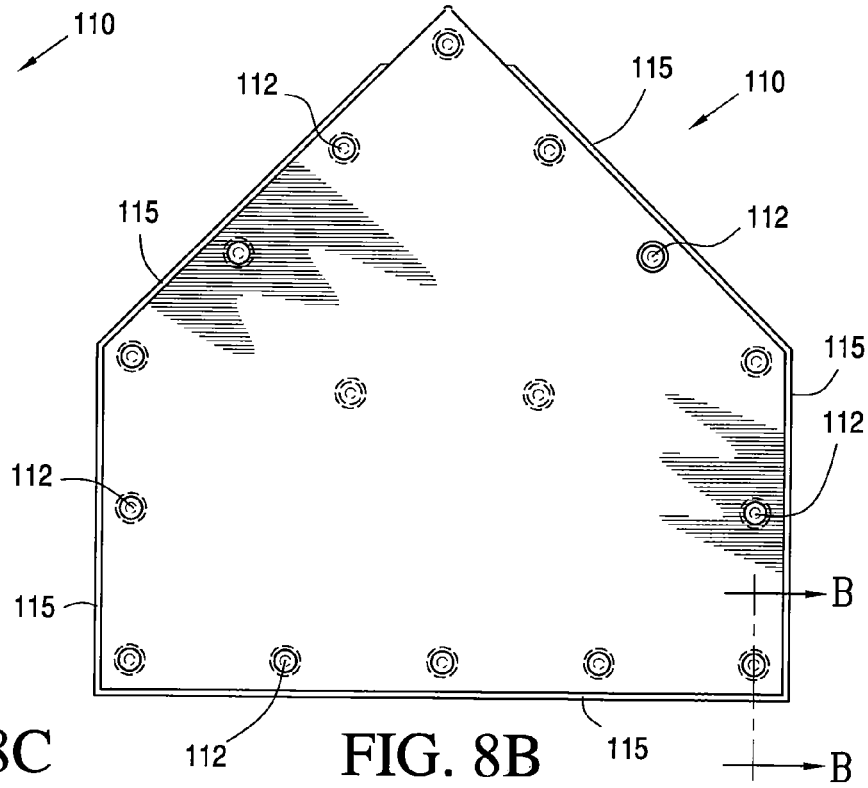
FIG. 8B

FIG. 19
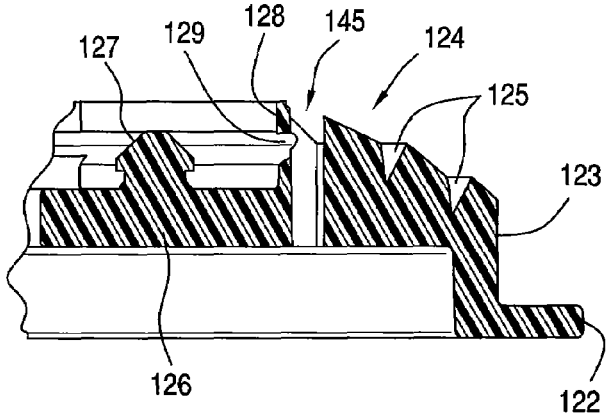
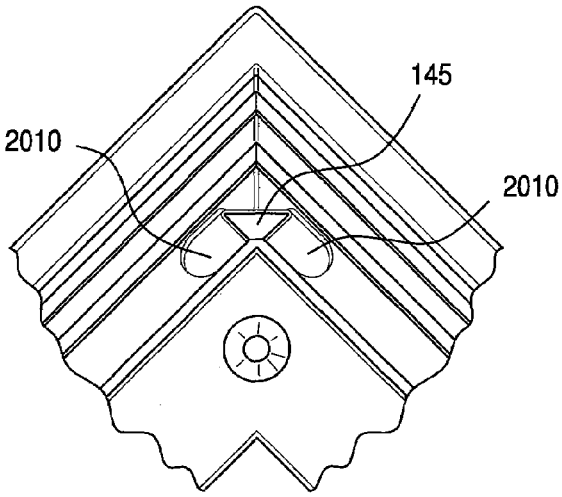
FIG. 20
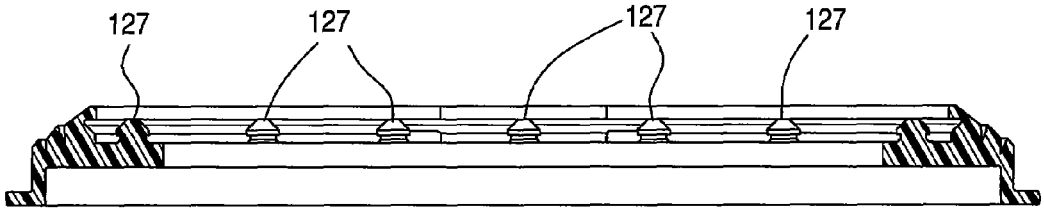
FIG. 21
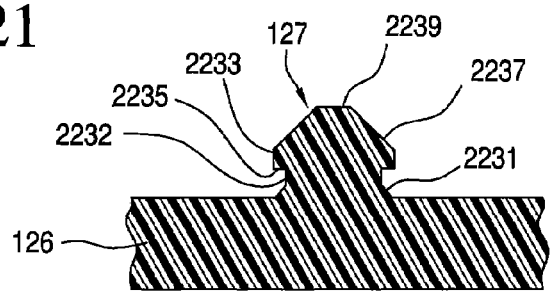
FIG. 22

HOME PLATE WITH UP-TIGHT BEVEL

CROSS REFERENCE TO RELATED APPLICATIONS

This application claims benefit of priority to U.S. Provisional Patent Application No. 60/882,725, filed Dec. 29, 2006 and which is herein incorporated in its entirety by reference.

TECHNICAL FIELD

Baseball and softball home plate systems generally, and more specifically a home plate system with changeable top plate sections and an up-tight bevel.

BRIEF DESCRIPTION OF THE DRAWINGS

Non-limiting and non-exhaustive embodiments of the present invention are described with reference to the following figures, wherein like reference numerals refer to like parts throughout the various views unless otherwise precisely specified.

FIG. 1 is a partially exploded top, front left perspective view of a home plate system, in accordance with an embodiment of the present invention.

FIG. 7 is a front right perspective view of a home plate system showing how a removable top plate portion is removed from a removable collar using a tool, in accordance with an embodiment of the present invention.

FIG. 8A is a top view of a top plate portion of a home plate system with a smooth top, in accordance with an embodiment of the present invention.

FIG. 8B is a bottom view of the top plate portion of the home plate system in FIG. 8A, in accordance with an embodiment of the present invention.

FIG. 8C is a side view of the top plate portion of the home plate system in FIGS. 8A and 8B, in accordance with an embodiment of the present invention.

FIG. 19 is a detailed view of highlighted area D of a home plate system in FIG. 18, in accordance with an embodiment of the present invention.

FIG. 20 is a detailed view of highlighted area C of a home plate system in FIG. 17, in accordance with an embodiment of the present invention.

FIG. 21 is a cross-sectional view of the removable collar of the home plate system of FIG. 17 along line B-B, in accordance with an embodiment of the present invention.

FIG. 22 is a detailed view of highlighted area F of a home plate system in FIG. 22, in accordance with an embodiment of the present invention.

DESCRIPTION

Figure 2A:
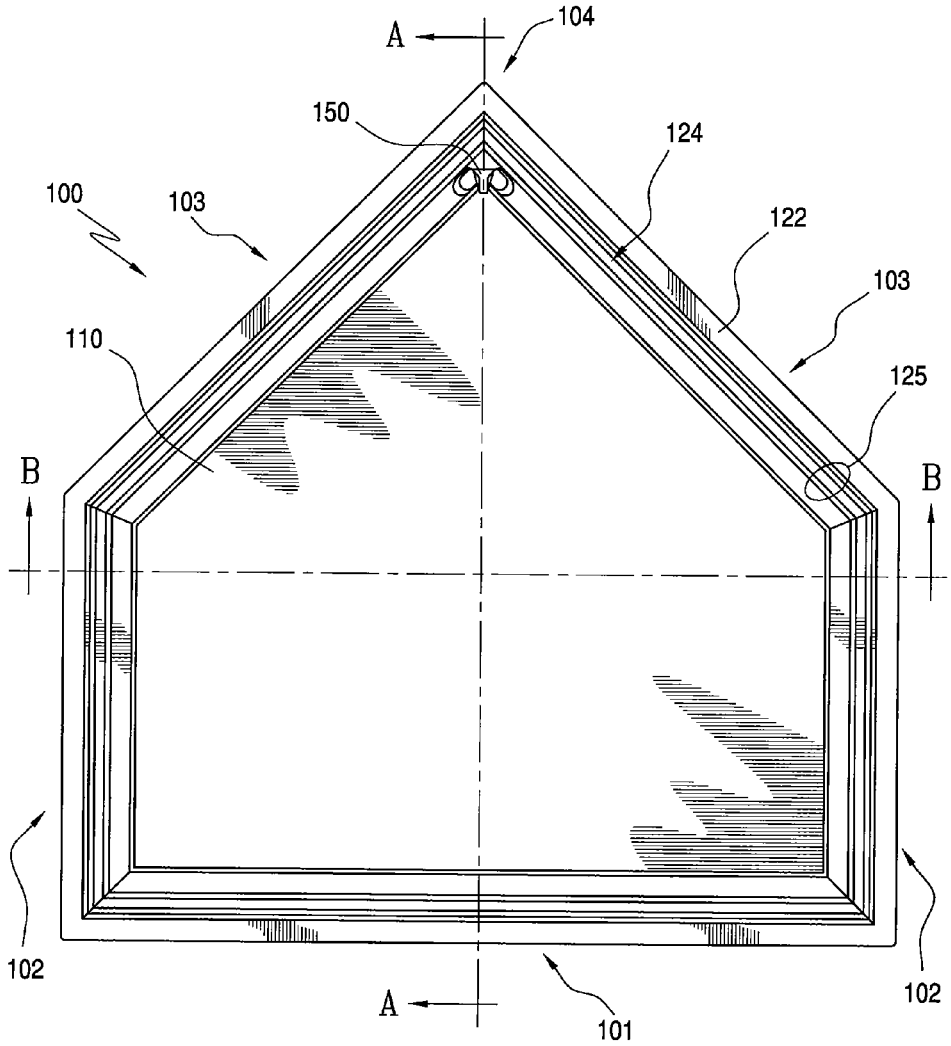
FIG. 2A is a top view of the home plate system of FIG. 1, in accordance with an embodiment of the present invention.

In accordance with one or more embodiments of the present invention, a home plate system may include (i.e., comprise) a base anchor, a removable collar with an up-tight bevel, a setup pin plug, a setup pin, and a removable home plate top plate section, as variously shown and described in the attached Drawings. In general, the home plate components may be manufactured from one or more elastomeric materials, for example, but not limited to, neoprene, to a variety of hardness qualities ranging from about 40 or less durometer (soft) to about 90 or higher durometer (hard). For example, but not limited to the following, the removable home plate top section may be made to have durometer readings of 40, 50, 60, 70 and 80 and with a smooth, a large grooved or a small grooved top surface. The style and level of hardness may be determined by the age of the players and level of the players skill, for example, for Major League Baseball smooth home plates with higher durometer readings will likely be used, while for Little League Baseball small grooved home plates with lower durometer readings and/or Youth League Softball large grooved home plates with lower durometer will likely be used. Similarly, lower durometer home plates will generally be used for non-metal cleats and higher durometer home plates will generally be used for metal cleats.

In accordance with one or more embodiments of the present invention, the removable home plate top section may also include a rib and/or retaining lip around substantially the entire perimeter of the removable home plate top section, which may be used to hold the home plate top section securely within a groove in the removable collar and one or more openings to receive a post anchor and/or upwardly protruding fastener. Also, one or more of the post anchors and/or upwardly protruding fasteners may be attached to the removable collar for mating with the bottom of the home plate top section may be replaced with male threaded and/or un-threaded posts, a threaded and/or un-threaded female channel for receiving a threaded and/or un-threaded fastener that may be inserted through the removable home plate top section. All materials used for the home plate system, in general, are environmentally sound and weather-resistant, to that end, multi-season testing (fall-winter-spring-summer) of the home plate system is being performed to validate the soundness and weather-resistance of a variety of different configurations (i.e., hardness and weather-resistance qualities) of the home plate system.

In accordance with one or more embodiments of the present invention, installation of the home plate system, generally, may be done according to the following. The proper location for the home plate system may be determined and a hole dug in the shape of the home plate system, but slightly larger and with a level bottom, so that the top surface of the removable top plate is level with the surrounding soil. The front of the home plate system may be aligned with the field by extending a string from the setup pin in the a back end of and across the home plate system over a centering mark in the removable top plate across the pitchers plate and to second base. Alternatively, the home plate system may be aligned with the field using the first and third base foul lines, but the foul lines need to be at a true 90-degree angle to each other for the alignment to be accurate.

The setup pin may be removed and the setup pin plug may be inserted into the setup plug opening and the hole may be refilled with the removed dirt up to the top of the home plate system, which may be manually compacted as well as watered to aid in the compacting.

FIG. 1 is a partially exploded top, front left perspective view of a home plate system, in accordance with an embodiment of the present invention. In FIG. 1, a home plate system 100 may include a removable top plate 110 positioned above a removable collar 120 into which removable top plate 110 may be removably fastened, and removable collar 120 is positioned above a base anchor 130 onto which removable collar 120 may likewise be removably fastened. The home plate system 100 may also include a setup pin plug 140 removably fastened in a setup pin opening 145 defined adjacent a back corner of removable collar 120. Setup pin plug 140, generally, is fastened in the setup pin opening 145 at all times, except when the field is being lined and a setup pin 150 is in the setup pin opening 145 to hold a string, cord and/or the like for use in applying the baselines to the field.

FIG. 2A is a top view of the home plate system of FIG. 1, in accordance with an embodiment of the present invention. In FIG. 2A, the removable top plate 110 of home plate system 100 is seated in and fastened to removable collar 120. However, base anchor 130 is not seen as it is obscured by removable top plate 110 and removable collar 120. Removable collar 120 may include an uptight bevel 122, a beveled edge 124 and two "V"-shaped grooves 125 that may extend longitudinally and continuously around the beveled edge 124. Home plate system 100, and each of the removable top plate 110, the removable collar 120 and the base anchor 130, has a front side 101, two substantially perpendicular sidewalls 102 depending away from opposite ends of front side 101 and two substantially diagonal sidewalls 103, each depending away from a distal end of one of the substantially diagonal sidewalls 103 and toward the distal end of the other substantially diagonal sidewall 103 until meeting at a back corner 104. Also seen adjacent back corner 104 is setup pin 150 disposed in setup pin opening 145.

Figure 2B:
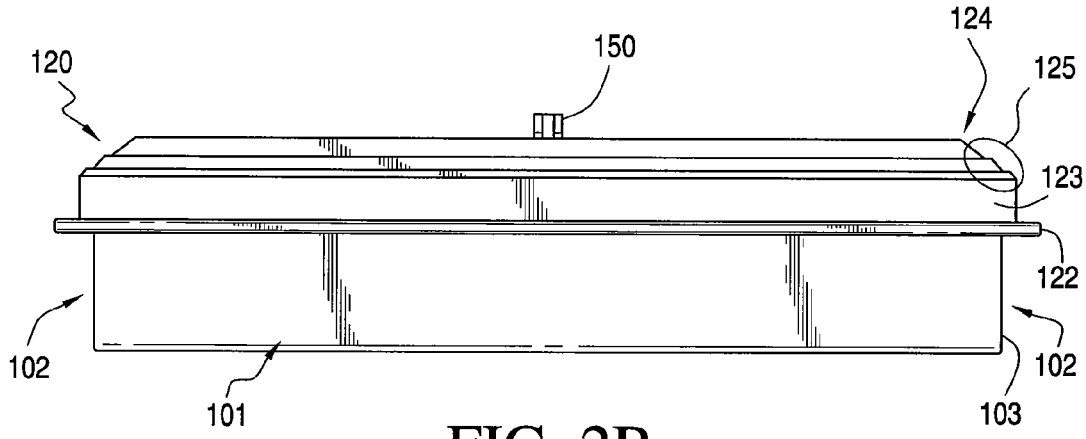
FIG. 2B is a side view of the home plate system of FIG. 2A, in accordance with an embodiment of the present invention.

FIG. 2B is a front side view of the home plate system of FIG. 2A, in accordance with an embodiment of the present invention. In FIG. 2B, the front side 101 of the home plate system 100 is shown to include base anchor 130 and removable collar 120, which obscures the view of removable top plate 110. A top of setup pin 150 may be seen extending above removable collar 120 from its position in setup pin opening 145.

Figure 3:
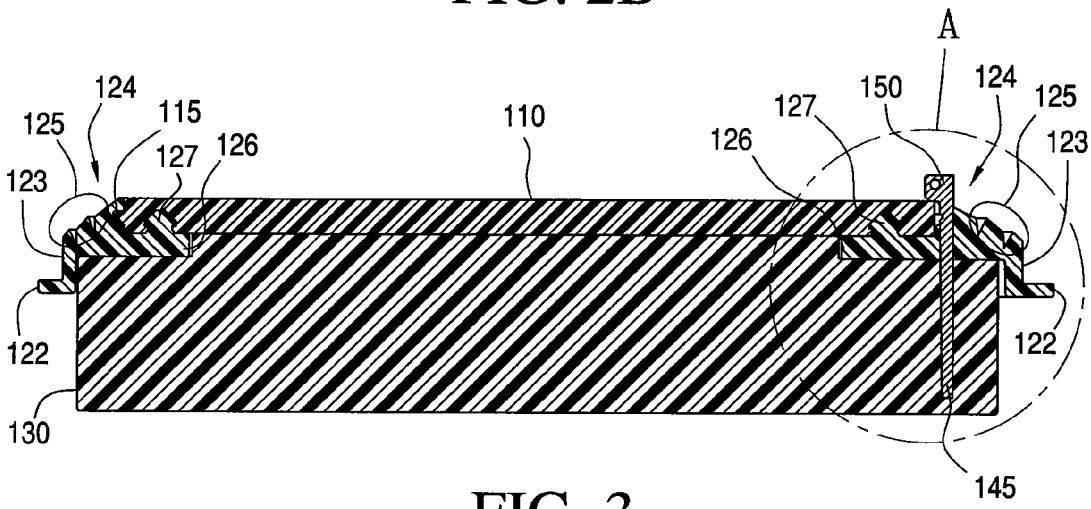
FIG. 3 is a cross-sectional view of the home plate system of FIG. 2A along line A-A, in accordance with an embodiment of the present invention.

FIG. 3 is a cross-sectional view of the home plate system of FIG. 2A along line A-A, in accordance with an embodiment of the present invention. In FIG. 3, line A-A extends from a center of front side 101 to back corner 104 and removable top plate 110 is seen seated in and fastened to removable collar 120, which in turn is seated on base anchor 130. Setup pin opening 145 is seen to extend from a top side of beveled edge 124 through removable collar 120 and almost completely through base anchor 130 near back corner 104. In FIG. 3, uptight bevel 122 defines the bottom of removable collar 120 and is substantially horizontal and an upright wall portion 123 extends substantially perpendicularly and upwardly away from an inner perimeter of uptight bevel 122 to a bottom of beveled edge 124. The bottom of beveled edge 124 extends substantially perpendicularly away from a top end of upright wall portion 123 toward a middle of removable collar 120. The top of beveled edge 124 extends diagonally upwardly and inwardly from the top end of upright wall portion 123 toward the middle of removable collar 120. Two "V"-shaped and substantially parallel channels 125 are located in approximately the middle of the top of beveled edge 124 and the two "V"-shaped channels 125 extend longitudinally around the entire top of beveled edge 124. The "V"-shaped channels 125 allow dirt/soil around an installed home plate system 100 to settle within the "V"-shaped channels 125, which aids in maintaining the dirt/soil around the top of the home plate system. In other embodiments of the present invention, the two "V"-shaped channels 125 may not extend longitudinally around the entire top of beveled edge 124. Instead, they may be a series of short and/or long "V"-shaped channel sections separated by un-grooved sections. Generally, the shorter the un-grooved sections the better the retention of dirt/soil around the top of an installed home plate system 100.

Figure 4:
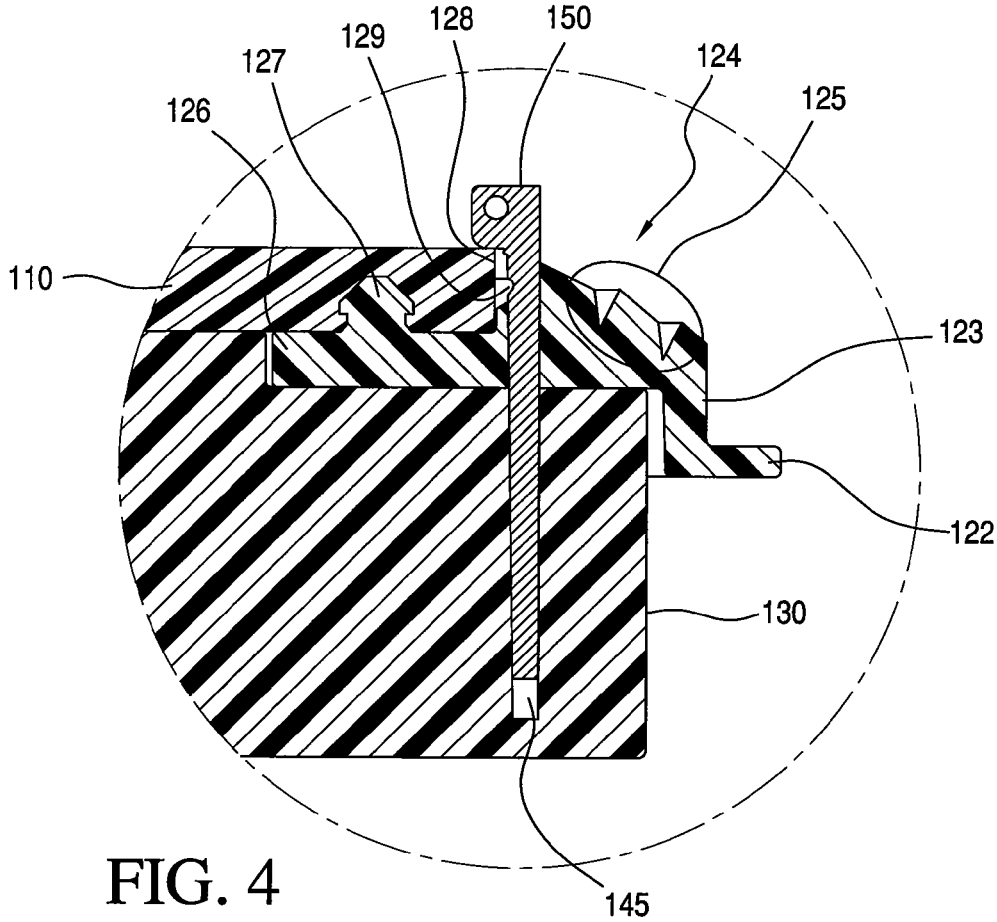
FIG. 4 is a detailed view of highlighted area A of a home plate system in FIG. 3, in accordance with an embodiment of the present invention.

In FIG. 3, at a top end of beveled edge 124, a downwardly depending face 128 extends toward a top side of a flange 126 that extends inwardly from beveled edge 124 toward the middle of removable collar 120. As better seen in FIG. 4, an inner groove 129 is disposed around the perimeter of downwardly depending face 128 to receive a ridge and/or beveled sidewall protrusion 115 that extends around substantially the entire perimeter of removable top plate 110. However, in FIGS. 3 and 4, no ridge is shown associated with removable top plate 110 near back corner 104. Although in other embodiments of the present invention the ridge may be continuous around the entire perimeter, in the present embodiment, not having the ridge near back corner 104 aids in the installation and removal of removable top plate 110. Returning to FIG. 3, on the top side of the flange 126 a post anchor and/or upwardly extending fastener 127 is removably fastened into a conforming opening in the bottom of removable top plate 110 at both the front end 101 and back corner 104 of removable top plate 110.

Figure 5:
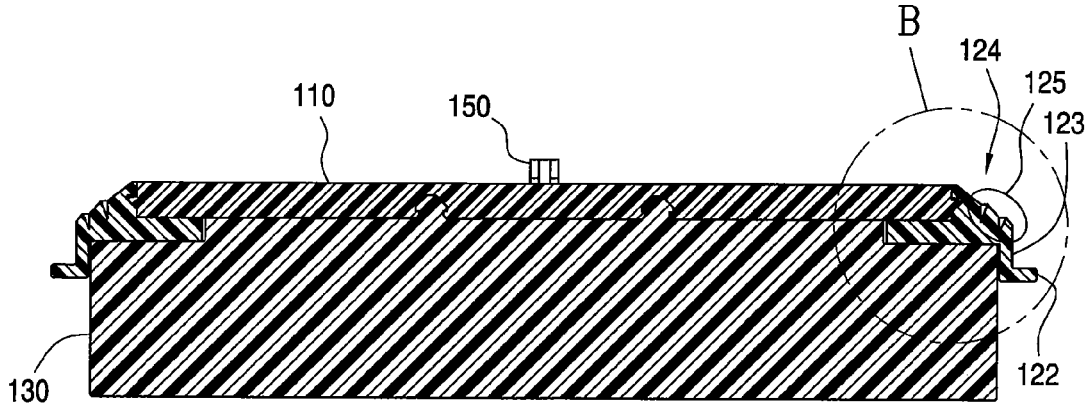
FIG. 5 is a cross-sectional view of the home plate system of FIG. 2A along line B-B, in accordance with an embodiment of the present invention.

FIG. 5 is a cross-sectional view of the home plate system of FIG. 2A along line B-B, in accordance with an embodiment of the present invention. In FIG. 5, line B-B extends perpendicular to line A-A from side-to-side of removable top plate 110, which is seen seated in and fastened to removable collar 120, which in turn is seated on base anchor 130. As in FIG. 3, in FIG. 5, uptight bevel 122 defines the bottom of removable collar 120 and is substantially horizontal and an upright wall portion 123 extends substantially perpendicularly and upwardly away from an inner perimeter of uptight bevel 122 to a bottom of beveled edge 124. The bottom of beveled edge 124 extends substantially perpendicularly away from a top end of upright wall portion 123 toward a middle of removable collar 120. The top of beveled edge 124 extends diagonally upwardly and inwardly from the top end of upright wall portion 123 toward the middle of removable collar 120. The two "V"-shaped and substantially parallel channels 125 are located in approximately the middle of the top of beveled edge 124 and the two "V"-shaped channels 125 extend longitudinally around the entire top of beveled edge 124.

Figure 6:
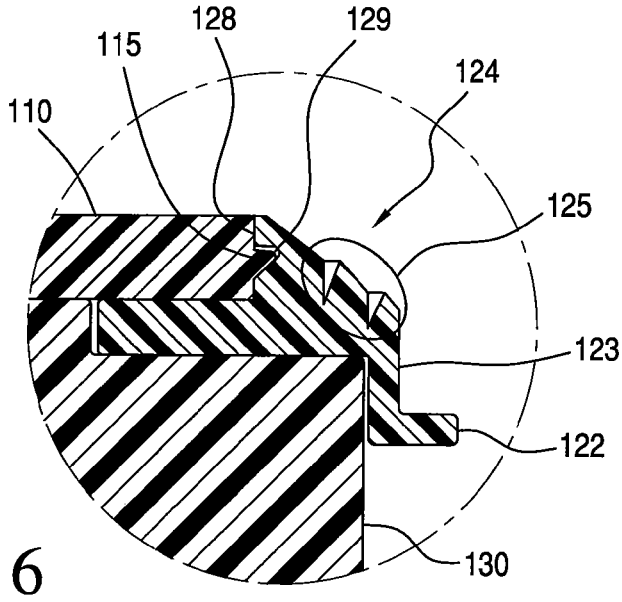
FIG. 6 is a detailed view of highlighted area B of a home plate system in FIG. 5, in accordance with an embodiment of the present invention.

In FIG. 5, at the top end of beveled edge 124, downwardly depending face 128 extends toward the top side of flange 126 that extends inwardly from beveled edge 124 toward the middle of removable collar 120. As better seen in FIG. 6, an inner groove 129 is disposed around the perimeter of downwardly depending face 128 to receive ridge and/or beveled sidewall protrusion 115 that extends around substantially the entire perimeter of removable top plate 110. Although in other embodiments of the present invention the ridge may be continuous around the entire perimeter, in the present embodiment, not having the ridge near back corner 104 aids in the installation and removal of removable top plate 110. Returning to FIG. 5, on the top side of the flange 126 a post anchor and/or upwardly extending fastener 127 is removably fastened into a conforming opening in the bottom of removable top plate 110 at both the front end 101 and back corner 104 of removable top plate 110.

FIG. 7 is a front right perspective view of a home plate system showing how a removable top plate portion is removed from a removable collar using a tool, in accordance with an embodiment of the present invention. In FIG. 7, a flat, rigid tool 710, for example, a Dig Out Tool™ from Rogers USA, Inc., assignee of the present invention, may be used to remove removable top plate 110 from removable collar 120 and base anchor 130. A front end 712 of tool 710 may be inserted into a slot/space 705 located on beveled edge 124 between removable top plate 110 and removable collar 120 and then the handle 714 of tool 710 may be pulled away from removable top plate 110 to pry up the portion of the side of removable top plate 110 against tool 710. Generally, placing tool 710 near or above the area on removable top plate 110 that does not have ridge 115 results in the most efficient and easiest removal of top plate 110. In FIG. 7, since the embodiment of removable top plate 110 does not have ridge 115 near back end 104, tool 710 is placed between removable top plate 110 and removable collar 120 near the area without ridge 115.

FIG. 8A is a top view of a top plate portion of a home plate system with a smooth top, in accordance with an embodiment of the present invention. In FIG. 8A, removable top plate 110 includes a ridge 115 extending substantially, completely around the outer perimeter of removable top plate 110. Two portions 117 of the outer perimeter of removable top plate 110 near back end 104 are without ridge 115. Multiple post anchor recesses and/or fastener recesses 112 are shown in shadow line to be located on a bottom of removable top plate 110. Recesses are generally located in each corner of removable top plate 110 and then evenly spaced between adjacent pairs of corner recesses. For example, between the recesses in the corners at the front end 101 of removable top plate 110, there are three substantially evenly spaced recesses with the middle of the three being substantially located in the middle of the front end 101 of removable top plate 110. Likewise, between the recesses in the corners of the sidewalls 102, there is a single recess and between the recesses in the corners of the diagonal sidewalls 103, there are two recesses. In addition, there are two recesses on opposite sides of the midline shown by line A-A and approximately midway between the front end 101 and back end 104. In accordance with the present embodiment, removable top plate 110 has an approximately 17" front end 101 not including ridge 115 and approximately 17.3" including ridge 115, an approximately 8.5" pair of sidewalls, and an approximately 12" pair of diagonal sidewalls that depend toward each other and meet at back end 104.

Although the above described configuration of recesses 112 and ridge 115 provides excellent retention of removable top plate 110, other embodiments are contemplated in which the same, more and/or less recesses 112 and ridge 115 are used. For example, but not limited to, any combination of the above described recesses, recesses only in the five corners, recesses in the five corners and one recess between each pair of corner recesses, no corner recesses and only one or more recesses on each side, ridge as described above, ridge only along substantially the entire length of each side but not around any corners, ridge only around corners, short ridge sections not next to recesses, short ridge sections only next to recesses, and the like.

FIG. 8B is a bottom view of the top plate portion of the home plate system in FIG. 8A, in accordance with an embodiment of the present invention. In FIG. 8B, the distance between recesses along front end 101 is approximately 3.9", the distance between recesses along sidewalls 102 is approximately 3.75", and the distance between recesses along diagonal sidewalls 103 is approximately 3.67". However, as described above, alternative embodiments with different spacing are contemplated.

Removable top plate 110 may also be used independently of the home plate system 100 for pitching, batting and/or other practice in, for example, a bull pen and/or other practice area by embedding removable top plate 110 in the ground. This may be accomplished by, for example, loosing the soil in an area slightly larger than the area of removable top plate 110, mixing water into the loosened soil until it becomes muddy, then pressing removable top plate 110 into the mud until the top of removable top plate 110 is level with the top of the mud, and allowing the mud to dry. Pressing removable top plate 110 into the mud forces mud up into recesses 112 and around and over ridge 115, so that when the mud dries, removable top plate 110 will be held substantially rigidly in place in the ground.

FIG. 8C is a side view of the top plate portion of the home plate system in FIGS. 8A and 8B, in accordance with an embodiment of the present invention. In FIG. 8C, ridge 115 is shown located in approximately the middle of the perimeter of removable top plate 110 extending along the entire length of sidewall 102, but only to within about 1.5" of back end 104.

Figure 9:
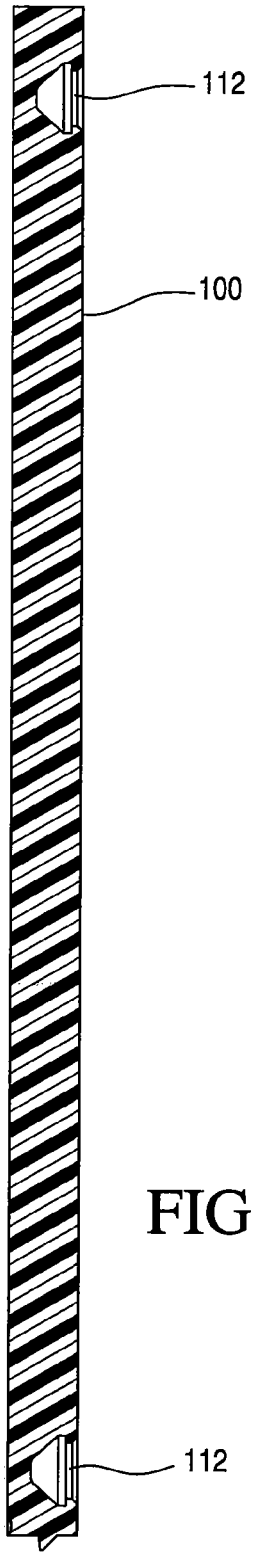
FIG. 9 is a cross-sectional view of the home plate system of FIG. 8A along line A-A, in accordance with an embodiment of the present invention.

FIG. 9 is a cross-sectional view of the home plate system of FIG. 8A along line A-A, in accordance with an embodiment of the present invention. In FIG. 9, recesses 112 in the back end 104 and middle of front end 101 are seen located near the perimeter of removable top plate 110.

Figure 10:
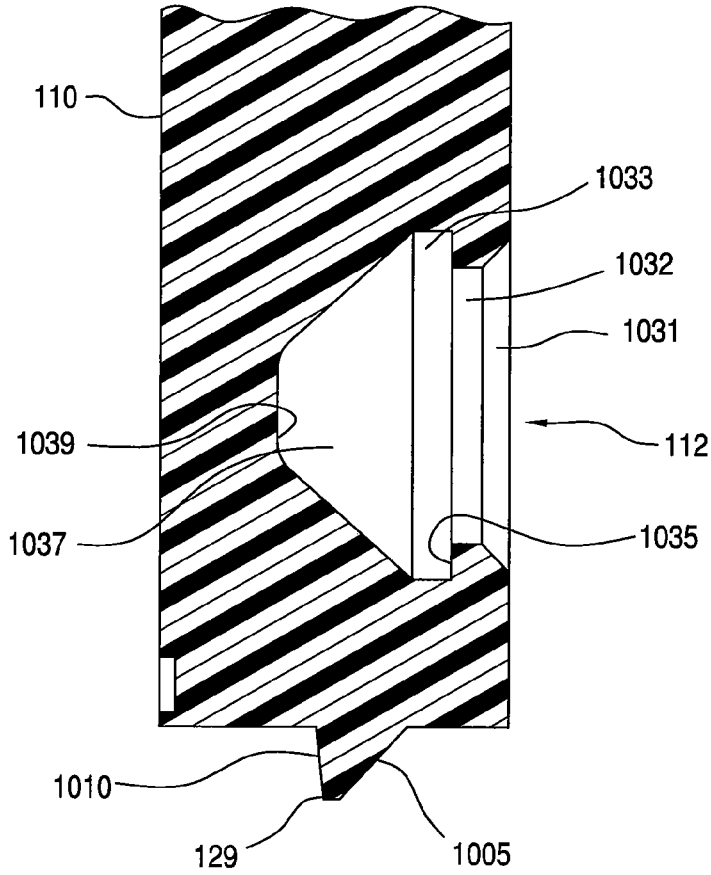
FIG. 10 is a cross-sectional view of the home plate system of FIG. 8B along line B-B, in accordance with an embodiment of the present invention.

FIG. 10 is a detailed cross-sectional view of the home plate system of highlighted area A of a home plate system in FIG. 9, in accordance with an embodiment of the present invention. In FIG. 10, details of removable top plate 110 around recess 112 and the perimeter of front end 101 of removable top plate 110 are seen. For example, but not limited to, removable top plate 110 may have a thickness of about 0.75" and ridge 129 may have an angled side 1005 depending upwardly from and located approximately in the middle of the perimeter of removable top plate 110 and a substantially flat surface 1010. Recess 112 is shown to have an initial beveled opening starting with a diameter of approximately 0.75" and after about 0.062" tapering down to a first constant diameter column 1032 with a diameter of approximately 0.6" and a length of approximately 0.063". First constant diameter column 1032 ends and a second constant diameter column 1033 with a diameter of approximately 0.75" and a length of approximately 0.085", which creates an interior lip 1035 to hold a post anchor and/or fastener. Second constant diameter column 1033 is subsequently connected to a tapered top portion 1037 that tapers inwardly away from second constant diameter column 1033 toward a substantially a flat top 1039 that ends approximately 0.5" in from the bottom of removable top plate 110.

Figure 11:
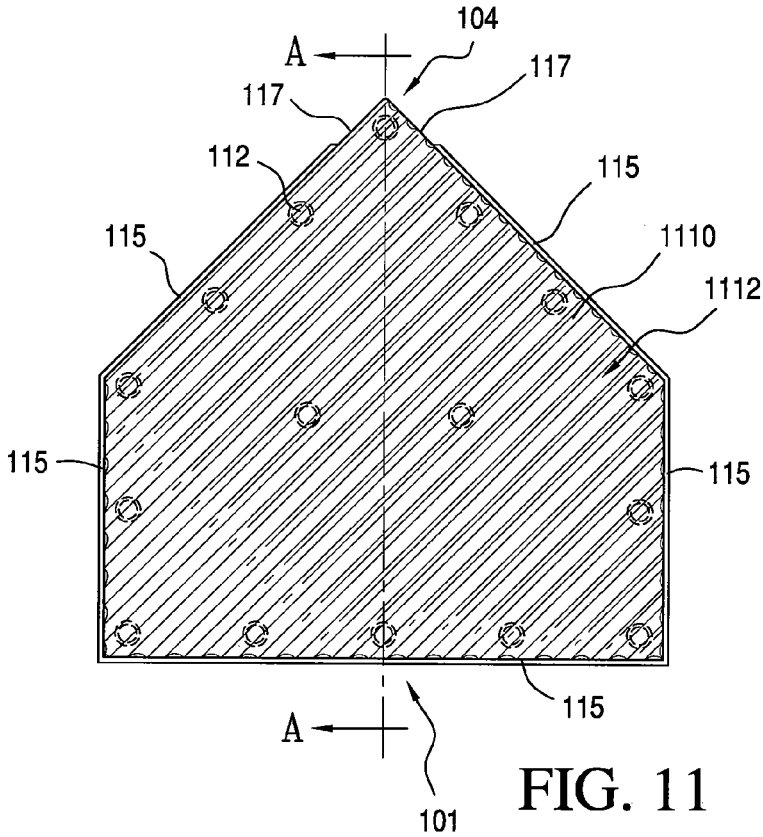
FIG. 11 is a top view of a top plate portion of a home plate system with large grooves on the top, in accordance with an embodiment of the present invention.

FIG. 11 is a top view of a top plate portion of a home plate system with large grooves on the top, in accordance with an embodiment of the present invention. As in FIG. 8A, in FIG. 11, a removable top plate 1110 with multiple large grooves 1112 on the top includes a ridge 115 extending substantially, completely around the outer perimeter of removable top plate 1110. Two portions 117 of the outer perimeter of removable top plate 1110 near back end 104 are without ridge 115. Multiple post anchor recesses and/or fastener recesses 112 are shown in shadow line to be located on a bottom of removable top plate 1110. Recesses are generally located in each corner of removable top plate 1110 and then evenly spaced between adjacent pairs of corner recesses. For example, between the recesses in the corners at the front end 101 of removable top plate 1110, there are three substantially evenly spaced recesses with the middle of the three being substantially located in the middle of the front end 101 of removable top plate 1110. Likewise, between the recesses in the corners of the sidewalls 102, there is a single recess and between the recesses in the corners of the diagonal sidewalls 103, there are two recesses. In addition, there are two recesses on opposite sides of the midline shown by line A-A and approximately midway between the front end 101 and back end 104. In accordance with the present embodiment, removable top plate 1110 has an approximately 17" front end 101 not including ridge 115 and approximately 17.3" including ridge 115, an approximately 8.5" pair of sidewalls, and an approximately 12" pair of diagonal sidewalls that depend toward each other and meet at back end 104.

Although the above described configuration of recesses 112 and ridge 115 provides excellent retention of removable top plate 1110, other embodiments are contemplated in which the same, more and/or less recesses 112 and ridge 115 are used. For example, but not limited to, any combination of the above described recesses, recesses only in the five corners, recesses in the five corners and one recess between each pair of corner recesses, no corner recesses and only one or more recesses on each side, ridge as described above, ridge only along substantially the entire length of each side but not around any corners, ridge only around corners, short ridge sections not next to recesses, short ridge sections only next to recesses, and the like.

Figure 12:
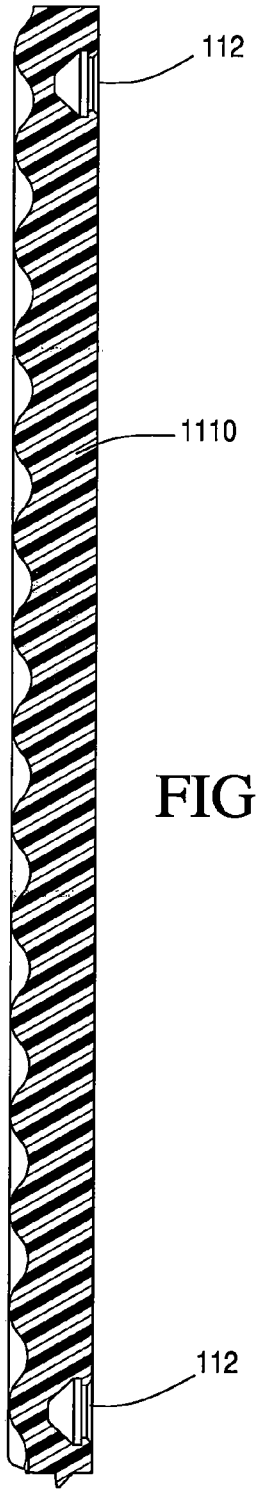
FIG. 12 is a cross-sectional view of the home plate system of FIG. 11 along line A-A, in accordance with an embodiment of the present invention.

FIG. 12 is a cross-sectional view of the home plate system of FIG. 11 along line A-A, in accordance with an embodiment of the present invention. In FIG. 12, recesses 112 in the back end 104 and middle of front end 101 are seen located near the perimeter of removable top plate 110. Also, the thickness of removable top plate 110 may vary between 0.75" in a groove trough and 0.95" at a top of a groove.

Figure 13:
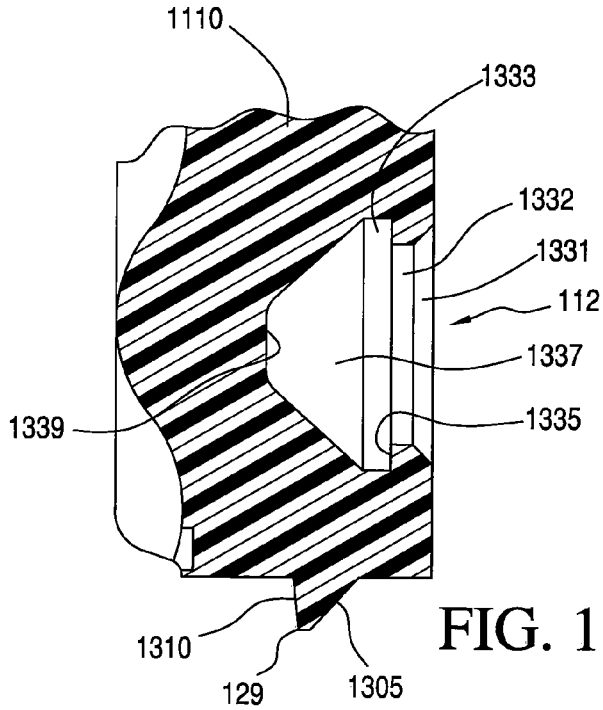
FIG. 13 is a detailed view of highlighted area A of a home plate system in FIG. 12, in accordance with an embodiment of the present invention.

FIG. 13 is a detailed cross-sectional view of highlighted area A of a home plate system in FIG. 12, in accordance with an embodiment of the present invention. In FIG. 13, details of removable top plate 1110 around recess 112 and the perimeter of front end 101 of removable top plate 1110 are seen. For example, but not limited to, removable top plate 1110 may have a thickness of about 0.75" to 0.95" and ridge 129 may have an angled side 1305 depending upwardly from and located approximately in the middle of the perimeter of removable top plate 110 and a substantially flat surface 1310. Recess 112 is shown to have an initial beveled opening starting with a diameter of approximately 0.75" and after about 0.062" tapering down to a first constant diameter column 1332 with a diameter of approximately 0.6" and a length of approximately 0.063". First constant diameter column 1332 ends and a second constant diameter column 1333 with a diameter of approximately 0.75" and a length of approximately 0.085", which creates an interior lip 1335 to hold a post anchor and/or fastener. Second constant diameter column 1333 is subsequently connected to a tapered top portion 1337 that tapers inwardly away from second constant diameter column 1333 toward a substantially flat top 1339 that ends approximately 0.5" in from the bottom of removable top plate 1310.

Figure 14:
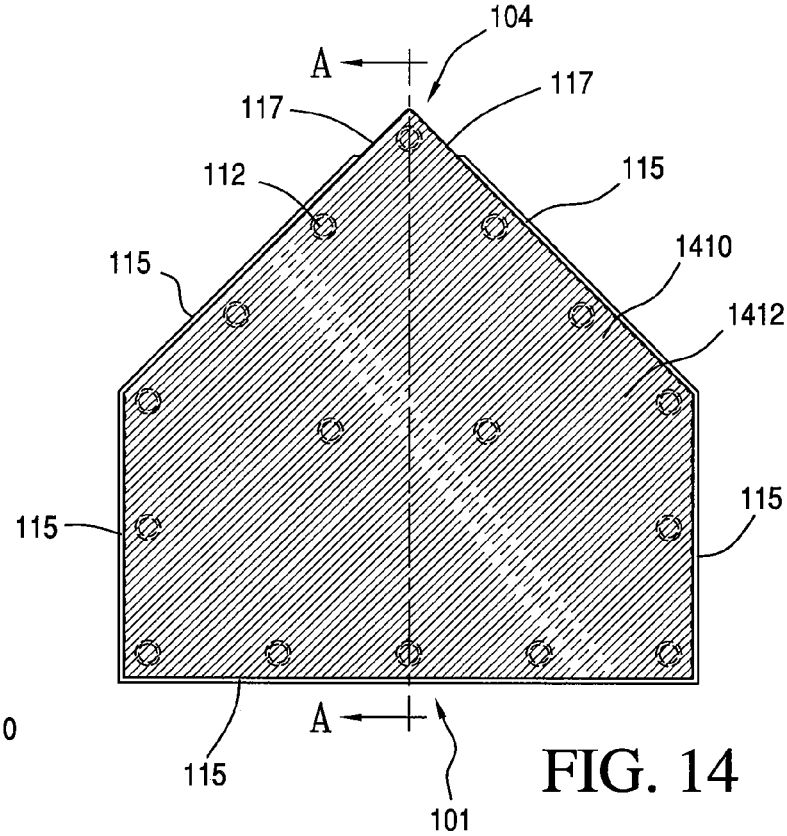
FIG. 14 is a top view of a top plate portion of a home plate system with small grooves on the top, in accordance with an embodiment of the present invention.

FIG. 14 is a top view of a top plate portion of a home plate system with small grooves on the top, in accordance with an embodiment of the present invention. As in FIG. 8A, in FIG. 14, a removable top plate 1410 with multiple small grooves 1412 on the top includes a ridge 115 extending substantially, completely around the outer perimeter of removable top plate

1410. Two portions 117 of the outer perimeter of removable top plate 1410 near back end 104 are without ridge 115. Multiple post anchor recesses and/or fastener recesses 112 are shown in shadow line to be located on a bottom of removable top plate 1410. Recesses are generally located in each corner of removable top plate 1410 and then evenly spaced between adjacent pairs of corner recesses. For example, between the recesses in the corners at the front end 101 of removable top plate 1410, there are three substantially evenly spaced recesses with the middle of the three being substantially located in the middle of the front end 101 of removable top plate 1410. Likewise, between the recesses in the corners of the sidewalls 102, there is a single recess and between the recesses in the corners of the diagonal sidewalls 103, there are two recesses. In addition, there are two recesses on opposite sides of the midline shown by line A-A and approximately midway between the front end 101 and back end 104. In accordance with the present embodiment, removable top plate 1410 has an approximately 17" front end 101 not including ridge 115 and approximately 17.3" including ridge 115, an approximately 8.5" pair of sidewalls, and an approximately 12" pair of diagonal sidewalls that depend toward each other and meet at back end 104.

Although the above described configuration of recesses 112 and ridge 115 provides excellent retention of removable top plate 1410, other embodiments are contemplated in which the same, more and/or less recesses 112 and ridge 115 are used. For example, but not limited to, any combination of the above described recesses, recesses only in the five corners, recesses in the five corners and one recess between each pair of corner recesses, no corner recesses and only one or more recesses on each side, ridge as described above, ridge only along substantially the entire length of each side but not around any corners, ridge only around corners, short ridge sections not next to recesses, short ridge sections only next to recesses, and the like.

Figure 15:
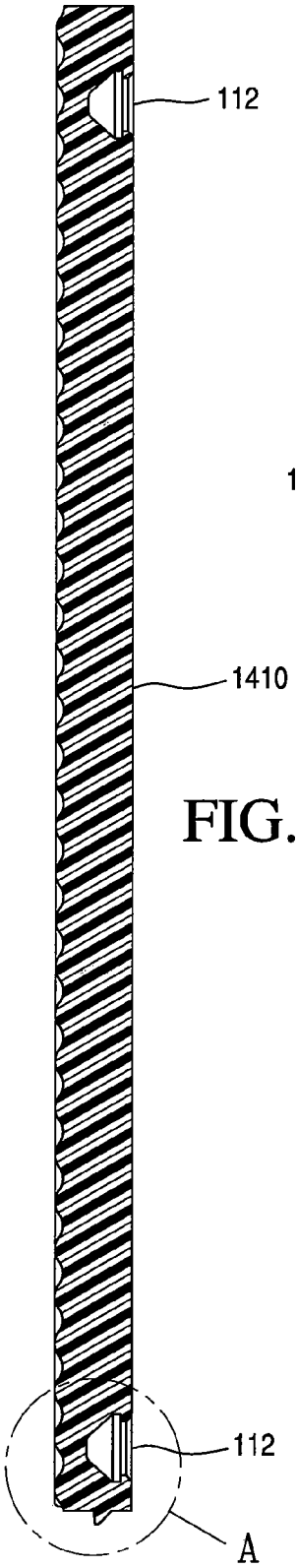
FIG. 15 is a cross-sectional view of the home plate system of FIG. 14 along line A-A, in accordance with an embodiment of the present invention.

FIG. 15 is a cross-sectional view of the home plate system of FIG. 14 along line A-A, in accordance with an embodiment of the present invention. In FIG. 15, recesses 112 in the back end 104 and middle of front end 101 are seen located near the perimeter of removable top plate 110. Also, the thickness of removable top plate 1410 may vary between 0.75" in a groove trough and 0.85" at a top of a groove.

Figure 16:
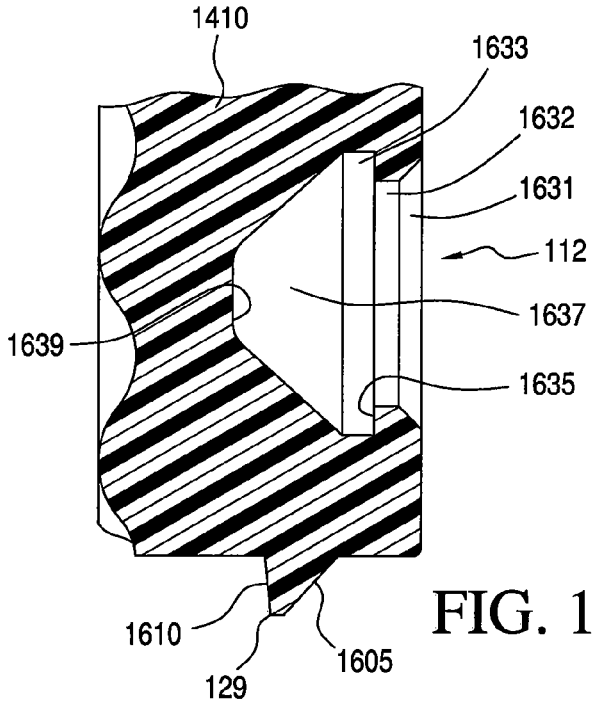
FIG. 16 is a detailed view of highlighted area A of a home plate system in FIG. 15, in accordance with an embodiment of the present invention.

FIG. 16 is a detailed cross-sectional view of highlighted area A of a home plate system in FIG. 15, in accordance with an embodiment of the present invention. In FIG. 16, details of removable top plate 1410 around recess 112 and the perimeter of front end 101 of removable top plate 1410 are seen. For example, but not limited to, removable top plate 1410 may have a thickness of about 0.75" to 0.95" and ridge 129 may have an angled side 1605 depending upwardly from and located approximately in the middle of the perimeter of removable top plate 1410 and a substantially flat surface 1610. Recess 112 is shown to have an initial beveled opening starting with a diameter of approximately 0.75" and after about 0.062" tapering down to a first constant diameter column 1632 with a diameter of approximately 0.6" and a length of approximately 0.063". First constant diameter column 1632 ends and a second constant diameter column 1633 with a diameter of approximately 0.75" and a length of approximately 0.085", which creates an interior lip 1635 to hold a post anchor and/or fastener. Second constant diameter column 1633 is subsequently connected to a tapered top portion 1637 that tapers inwardly away from second constant diameter column 1633 toward a substantially flat top 1639 that ends approximately 0.5" in from the bottom of removable top plate 1410.

Figure 17:
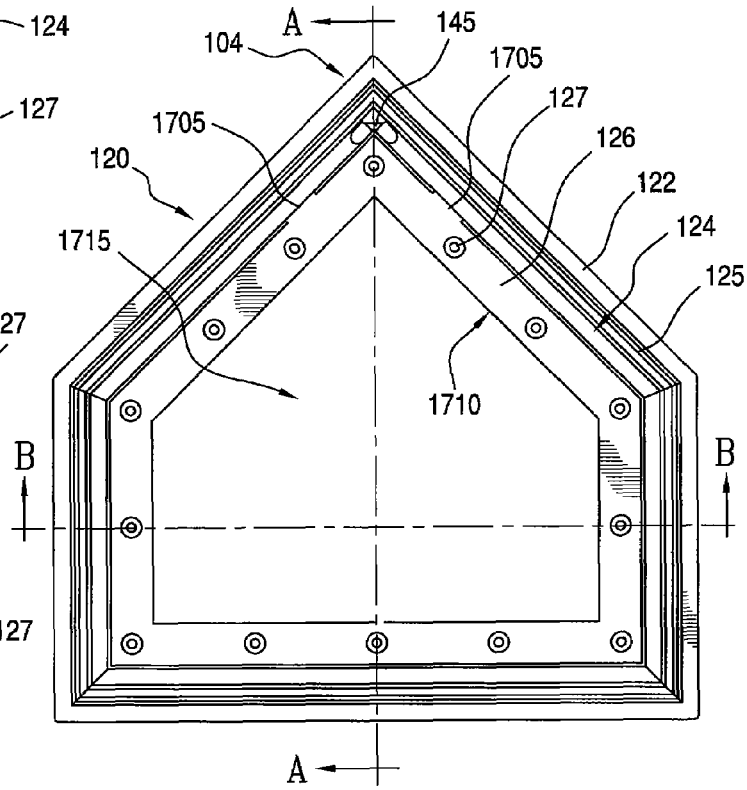
FIG. 17 is a top view of a removable collar of a home plate system, in accordance with an embodiment of the present invention.

FIG. 17 is a top view of a removable collar of a home plate system, in accordance with an embodiment of the present invention. In FIG. 17, removable collar 120 may include uptight bevel 122, beveled edge 124 and two "V"-shaped grooves 125 that may extend longitudinally and continuously around the beveled edge 124. Two slots 1705 may be located in an interior face 128 of beveled edge on diagonal sidewalls 103 to aid in the removal of removable top plate 110. Removable collar 120 may also include flange 126, which has an inner perimeter 1710 defining and opening 1715 for base anchor 130, and multiple post anchors 127 located around flange 126. Multiple post anchors are sized to fit within and located in positions predetermined to be able to cooperate with and fasten to recesses 112 in removable top plate 110. Also seen adjacent back corner 104 is setup pin opening 145.

Figure 18:
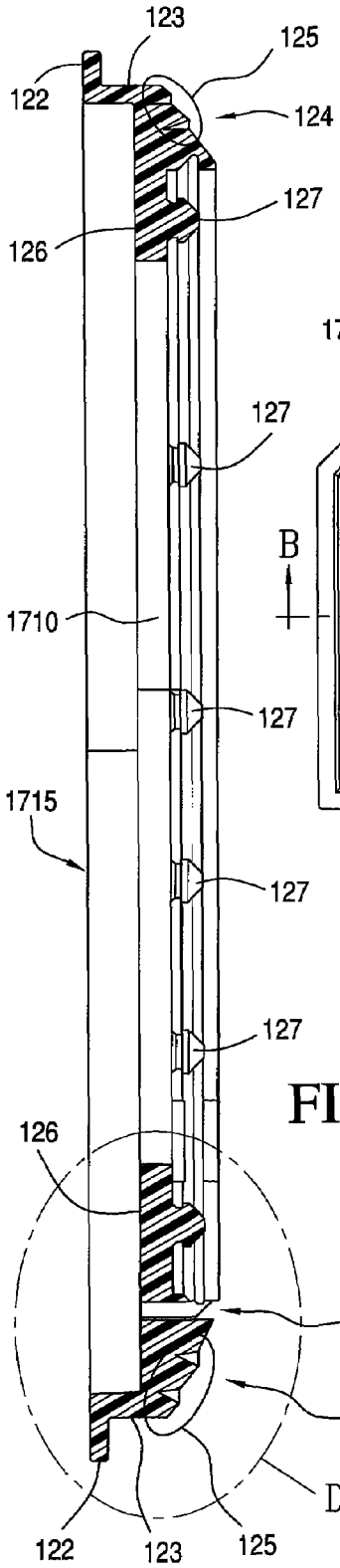
FIG. 18 is a cross-sectional view of the removable collar of the home plate system of FIG. 17 along line A-A, in accordance with an embodiment of the present invention.

FIG. 18 is a cross-sectional view of the removable collar of the home plate system of FIG. 17 along line A-A, in accordance with an embodiment of the present invention. In FIG. 18, setup pin opening 145 is seen to extend from a top side of beveled edge 124 through and out a bottom of removable collar 120. In FIG. 18, uptight bevel 122 defines the bottom of removable collar 120 and is substantially horizontal and an upright wall portion 123 extends substantially perpendicularly and upwardly away from an inner perimeter of uptight bevel 122 to a bottom of beveled edge 124. The bottom of beveled edge 124 extends substantially perpendicularly away from a top end of upright wall portion 123 toward a middle of removable collar 120. The top of beveled edge 124 extends diagonally upwardly and inwardly from the top end of upright wall portion 123 toward the middle of removable collar 120. Two "V"-shaped and substantially parallel channels 125 are located in approximately the middle of the top of beveled edge 124 and the two "V"-shaped channels 125 extend longitudinally around the entire top of beveled edge 124. The "V"-shaped channels 125 allow dirt/soil around an installed home plate system 100 to settle within the "V"-shaped channels 125, which aids in maintaining the dirt/soil around the top of the home plate system. In other embodiments of the present invention, the two "V"-shaped channels 125 may not extend longitudinally around the entire top of beveled edge 124. Instead, they may be a series of short and/or long "V"-shaped channel sections separated by un-grooved sections. Generally, the shorter the un-grooved sections the better the retention of dirt/soil around the top of an installed home plate system 100.

In FIG. 19, at a top end of beveled edge 124, a downwardly depending face 128 extends toward a top side of a flange 126 that extends inwardly from beveled edge 124 toward the middle of removable collar 120. An inner groove 129 is disposed around the perimeter of downwardly depending face 128 to receive a ridge and/or beveled sidewall protrusion 115 that extends around substantially the entire perimeter of removable top plate 110. On the top side of the flange 126 a post anchor and/or upwardly extending fastener 127 is located and configured to be removably fastened into a conforming recess 112 in the bottom of removable top plate 110 at both the front end 101 and back corner 104 of removable top plate 110.

FIG. 20 is a detailed view of highlighted area C of a home plate system in FIG. 17, in accordance with an embodiment of the present invention. In FIG. 20, a setup pin opening 145 is seen defined in beveled edge 124 above the top "V-shaped" groove 125 in the back end 104 of removable collar 120 with associated flap recesses 2010 for receiving the setup pin opening plug 140.

FIG. 21 is a cross-sectional view of the removable collar of the home plate system of FIG. 17 along line B-B, in accordance with an embodiment of the present invention. In FIG. 21, a cross-sectional view of the post anchors 127 on sidewalls 102 are seen along with a side view of post anchors 127 along diagonal sidewalls 103.

FIG. 22 is a detailed view of highlighted area F of a home plate system in FIG. 22 showing the configuration of a post anchor, in accordance with an embodiment of the present invention. In FIG. 22, details of flange 126 and a post anchor 127 around the perimeter are seen. For example, but not limited to, flange 126 may have a thickness of about 0.5" and post anchor 127 may extend above flange 126 by approximately 0.47". Recess 112 is shown to have an initial beveled foot portion 2231 starting with a diameter of approximately 0.625" and after about 0.06" tapering down to a first constant diameter column 2232 with a diameter of approximately 0.5" and a length of approximately 0.1". First constant diameter column 2232 ends and a second constant diameter column 2233 with a diameter of approximately 0.625" and a length of approximately 0.09", which creates a ledge 2235 to rest against interior lip 1635 in recess 112 to removably hold post anchor and/or fastener 127 in place within recess 112. Second constant diameter column 2233 is subsequently connected to a tapered cap 2237 that tapers inwardly away from second constant diameter column 2233 toward a substantially flat top 2239 that ends approximately 0.47" above the second constant diameter column 2233.

Figure 23:
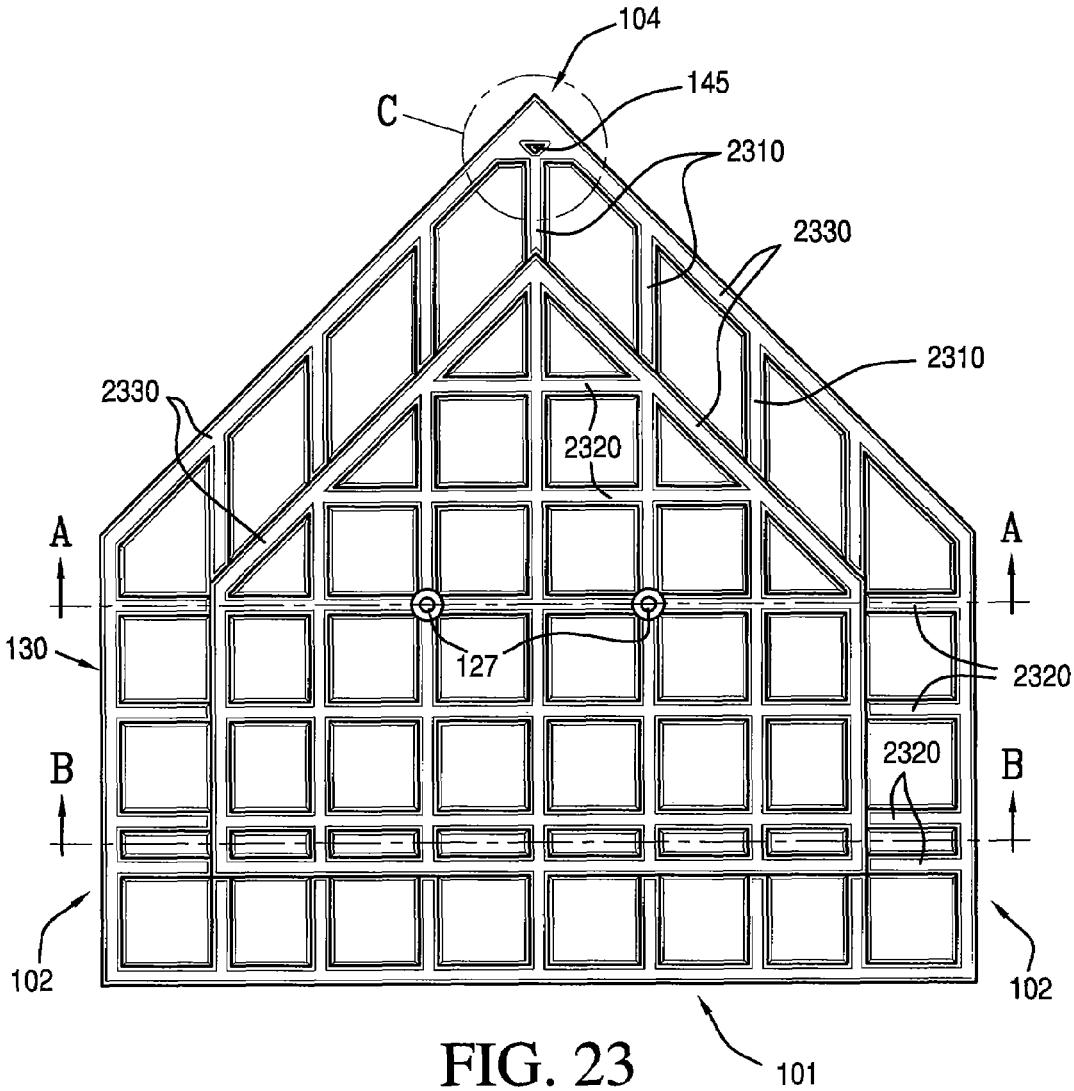
FIG. 23 is a top view of an anchor section of a home plate system, in accordance with an embodiment of the present invention.

FIG. 23 is a top view of an anchor section of a home plate system, in accordance with an embodiment of the present invention. In FIG. 23, anchor section 130 includes multiple, individually walled sections formed by the intersections of multiple longitudinal walls 2310 extending from the front end 101 to the back end 104, multiple latitudinal walls 2320 extending completely or only partially between sidewalls 102, and diagonal walls 2330. The intersecting walls provide stability and strength to base anchor 130 without having to have a solid base, which keeps the weight of the base anchor 130 at a minimum. In addition, the openings formed by the intersecting walls may be used to house one or more sensors, for example, but not limited to, infrared sensors, acoustic sensors, other line-of-sight sensors, near field sensors, low energy sensors, and radio frequency (RF) sensors for detecting whether a pitch is a ball or a strike. In addition to the sensors, a source of power and a signal processing capability may be associated with the sensors either within the home plate system and/or in an external, off-plate location, for example, but not limited to, behind a backstop, in a dugout and/or in other housings. Additional modifications of the internal configuration of the anchor base 134 may include channels, grooves, and the like for wiring interconnections between sensors and/or the source of power and/or the signal processing capability. However, wireless communications may also be used between the sensors and the signal processing capability.

Figure 24:
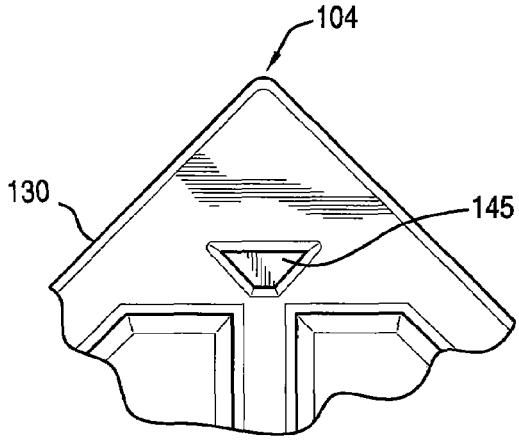
FIG. 24 is a detailed view of highlighted area C of the anchor section a home plate system in FIG. 23, in accordance with an embodiment of the present invention.

FIG. 24 is a detailed view of highlighted area C of the anchor section of the home plate system in FIG. 23, in accordance with an embodiment of the present invention. In FIG. 24, the setup pin opening 145 has a trapezoidal and/or triangular shape to receive the setup pin 150 and prevent rotation of setup pin 150 within setup pin opening 145. In addition, the shape of setup pin opening 145 ensures that setup pin 150 is always installed correctly, since the trapezoidal and/or triangular shape acts as a directional key in that setup pin 150 may only be inserted into setup pin opening 145 in one direction.

Figure 25:
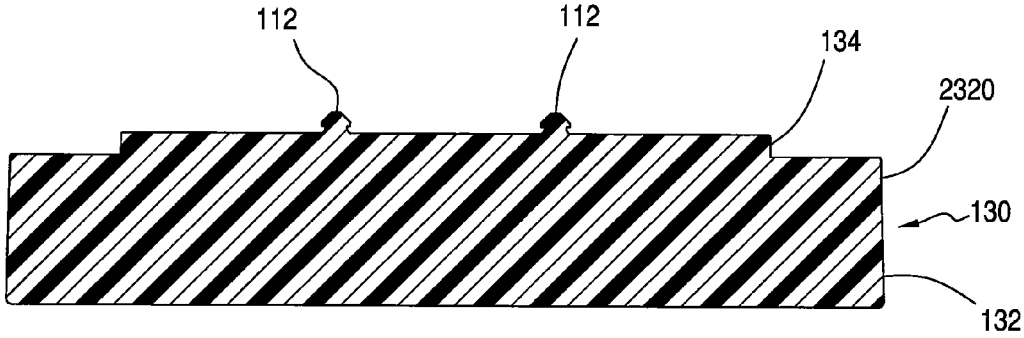
FIG. 25 is a cross-sectional view of the anchor section of the anchor section system of FIG. 23 along line A-A, in accordance with an embodiment of the present invention.

FIG. 25 is a cross-sectional view of the anchor section of the anchor section system of FIG. 23 along line A-A, in accordance with an embodiment of the present invention. In FIG. 25, line A-A extends along a middle one of the latitudinal walls 2320 with two post anchors and/or fasteners 127 connected to the top of the latitudinal wall 2320. The dimensions of the post anchors and/or fasteners 127 are the same as those described for FIG. 22 and the post anchors and/or fasteners 127 of FIG. 25 are approximately equal distance from a center one of the longitudinal walls 2330 and positioned to cooperatively engage the recesses 112 in the middle of top plate 110. Anchor base 130 includes a lower portion 132 with a height of approximately 3.25" around a perimeter of base anchor 130 and a raised portion 134 with a height of approximately 3.75" in the center of anchor base 130 and surrounded by lower portion 132. When removable collar 120 is combined with anchor base 130, the raised portion 134 fits between the inner perimeter of flange 126 of the removable collar 120 and the top of the raised portion 134 is substantially level with the top of flange 126.

Figure 26:
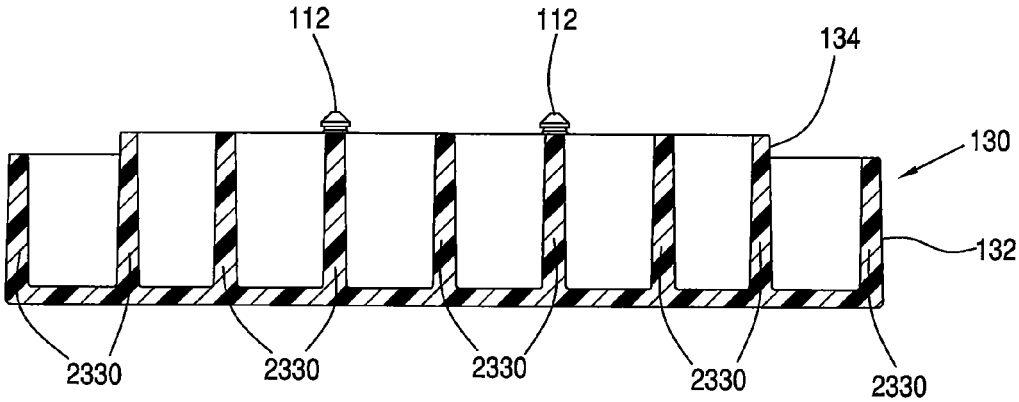
FIG. 26 is a cross-sectional view of the anchor section of the home plate system of FIG. 23 along line B-B, in accordance with an embodiment of the present invention.

FIG. 26 is a cross-sectional view of the anchor section of the home plate system of FIG. 23 along line B-B, in accordance with an embodiment of the present invention. In FIG. 26, line B-B extends between two of the latitudinal walls 2320. Nine longitudinal walls 2330 divide up base anchor 130 into 8 columns that are further divided by seven latitudinal walls 2320 to produce multiple, substantially square, rectangular, triangular and/or trapezoidal divisions within base anchor 130. Two post anchors and/or fasteners 127 are affixed atop latitudinal walls 2320 on either side of a middle one of the latitudinal walls 2320. The dimensions of the post anchors and/or fasteners 127 are the same as those described for FIG. 22 and the post anchors and/or fasteners 127 of FIG. 26 are approximately equal distance from a center one of the latitudinal walls 2330 and positioned to cooperatively engage the recesses 112 in the middle of top plate 110. Anchor base 130 includes lower portion 132 around a perimeter of base anchor 130 and a raised portion 134 in the center of anchor base 130 and surrounded by lower portion 132. When removable collar 120 is combined with anchor base 130, the raised portion 134 fits between the inner perimeter of flange 126 of the removable collar 120 and the top of the raised portion 134 is substantially level with the top of flange 126. Although the present embodiment shows two post anchors and/or fasteners in the middle of raised portion 134, other embodiments are also contemplated in which fewer or more post anchors and/or fasteners, for example, zero or one, or three or more are in raised portion 134. Likewise, a variety of configurations of the post anchors and/or fasteners are contemplated atop longitudinal walls 2330 and/or latitudinal walls 2320.

Figure 27:
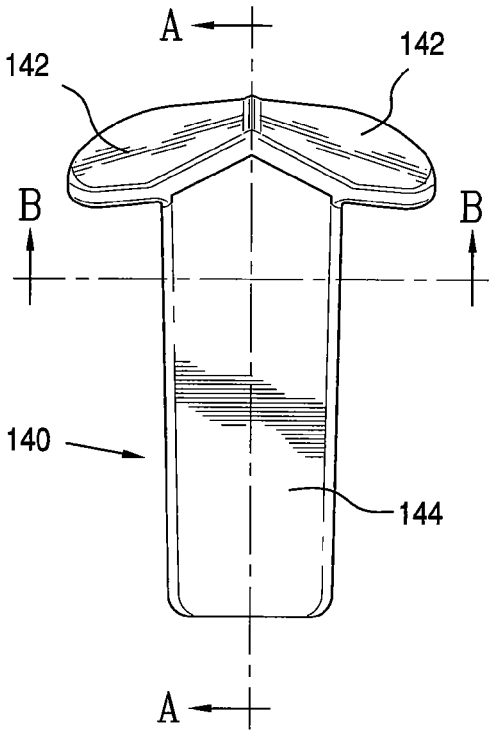
FIG. 27 is a front view of a setup pin plug of a home plate system, in accordance with an embodiment of the present invention.

FIG. 27 is a front view of a setup pin plug of a home plate system, in accordance with an embodiment of the present invention. In FIG. 27, setup pin plug 140 includes a pair of mirror image flaps 142 atop a plug body 144. The mirror image flaps 142 are designed to fit within flap recesses 2010 so that the tops of the mirror image flaps 142 are level with beveled edge 124 when setup pin plug 140 is in place in setup pin opening 145.

Figure 28:
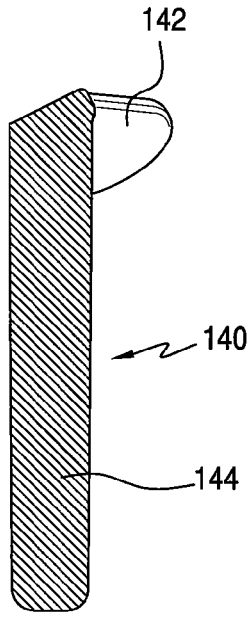
FIG. 28 is a cross-sectional view of the setup pin plug of the home plate system of FIG. 27 along line A-A, in accordance with an embodiment of the present invention.

FIG. 28 is a cross-sectional view of the setup pin plug of the home plate system of FIG. 27 along line A-A, in accordance with an embodiment of the present invention.

Figure 29:
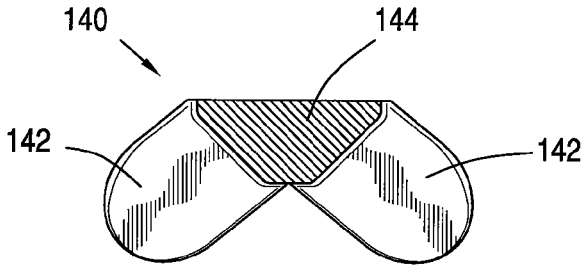
FIG. 29 is a cross-sectional view of the setup pin plug of the home plate system of FIG. 27 along line B-B, in accordance with an embodiment of the present invention.

FIG. 29 is a cross-sectional view of the setup pin plug of the home plate system of FIG. 27 along line B-B, in accordance with an embodiment of the present invention. In FIG. 29, a longitudinal cross-section of setup pin plug 140 partially showing the substantially trapezoidal and/or triangular shape of the body of setup pin 150 and the bottom of the mirror image flaps 142.

Figure 30:
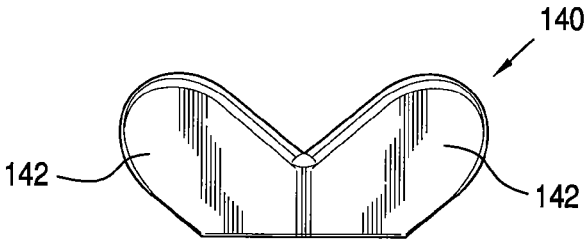
FIG. 30 is a top view of the setup pin plug of the home plate system of FIG. 27, in accordance with an embodiment of the present invention.

FIG. 30 is a top view of the setup pin plug of the home plate system of FIG. 27, in accordance with an embodiment of the present invention. In FIG. 30, the tops of the mirror image flaps 142 are abutted to each other at an angle sufficient to span the angle between the two diagonal sidewalls.

Figure 31:
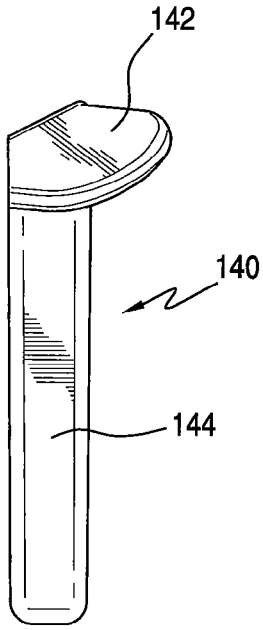
FIG. 31 is a side view of the setup pin plug of the home plate system of FIG. 31, in accordance with an embodiment of the present invention.

FIG. 31 is a side view of the setup pin plug of the home plate system of FIG. 31, in accordance with an embodiment of the present invention. In FIG. 31, setup pin plug 140 is shown to be approximately 1.63" tall.

Figure 32:
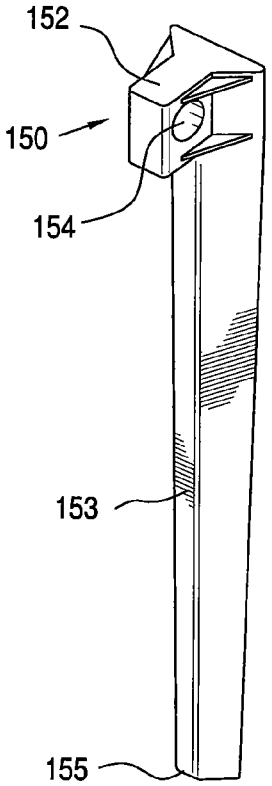
FIG. 32 is a front perspective view of a setup pin of a home plate system, in accordance with an embodiment of the present invention.

FIG. 32 is a front perspective view of a setup pin of a home plate system, in accordance with an embodiment of the present invention. In FIG. 32, setup pin 150 includes a head portion 152 that defines a hole 154 there through and a body portion 153. The body portion 153 is adapted to cooperatively engage setup pin opening 145 in removable collar 120 to hold setup pin 150 from moving during installation and/or field setup. Body portion 153 may taper from larger to smaller and hole 154 may be used to pass string and/or cord through it to align home plate during installation and/or to line the base lines for play. Setup pin 150 may be made from a variety of methods and materials including, but not limited to, die cast metal (e.g., zinc), extruded reinforced plastic, injection molded plastic, and the like.

Figure 33:
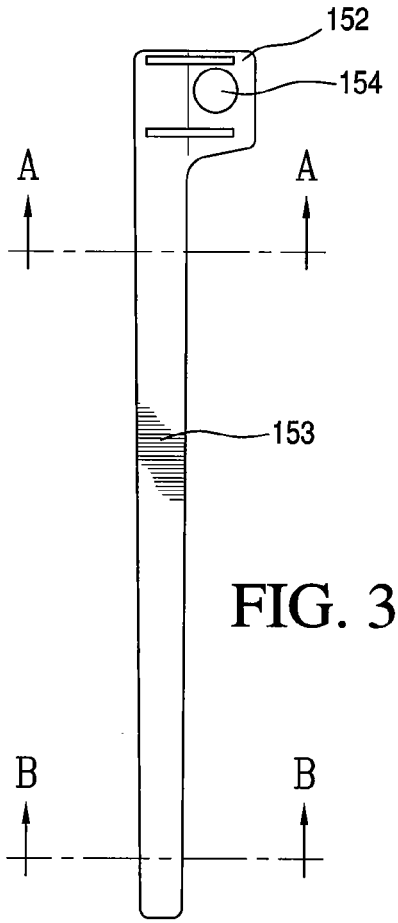
FIG. 33 is a side view of the setup pin of the home plate system of FIG. 32, in accordance with an embodiment of the present invention.

FIG. 33 is a side view of the setup pin of the home plate system of FIG. 32, in accordance with an embodiment of the present invention. In FIG. 33, the setup pin 150 has body 153 that tapers from just below the head 152 to an end of the body 155. The taper of body 153 helps to further hold setup pin 150 steady due to the frictional engagement of body 153 within setup pin opening 145. Head 152 is substantially rectangular shaped with opening 154 and is affixed atop body 153 and when setup pin 150 is inserted into setup pin opening 145, opening 154 faces toward the center of the home plate system 100.

Figure 34:
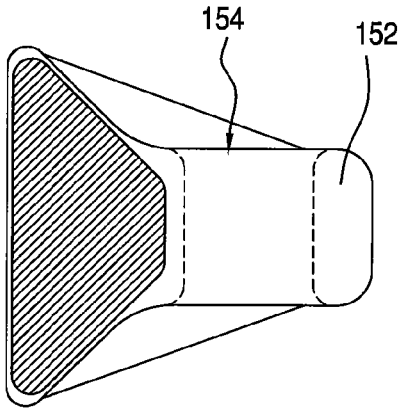
FIG. 34 is a cross-sectional view of the setup pin of the home plate system of FIG. 32 along line A-A, in accordance with an embodiment of the present invention.

FIG. 34 is a cross-sectional view of the setup pin of the home plate system of FIG. 32 along line A-A, in accordance with an embodiment of the present invention. In FIG. 34, a cross-section of body 153 near the top of body 153 is shown to have a back length of 0.543", a front length of 0.115" and a width of 0.245".

Figure 35:
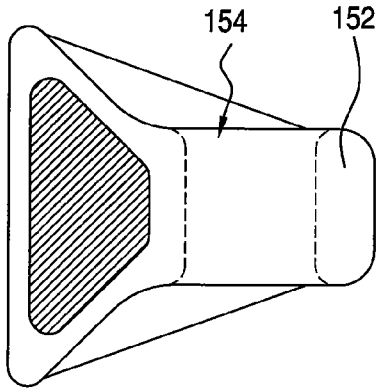
FIG. 35 is a cross-sectional view of the setup pin of the home plate system of FIG. 32 along line B-B, in accordance with an embodiment of the present invention.

FIG. 35 is a cross-sectional view of the setup pin of the home plate system of FIG. 32 along line B-B, in accordance with an embodiment of the present invention. In FIG. 35. a cross-section of body 153 near the bottom of body 153 is shown to have a back length of 0.416", a front length of 0.093" and a width of 0.193", which are significantly smaller than the measurements in FIG. 34 of a back length of 0.543", a front length of 0.115" and a width of 0.245".

Figure 36:
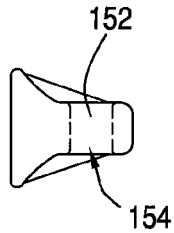
FIG. 36 is top view of the setup pin of the home plate system of FIG. 32, in accordance with an embodiment of the present invention.

FIG. 36 is top view of the setup pin of the home plate system of FIG. 32, in accordance with an embodiment of the present invention. In FIG. 36, opening 154 is shown in shadow line to extend from one side of head 152 through to the other side of head 152.

In accordance with at least one embodiment of the present invention, a home plate system including a removable top plate including a top, a bottom and a sidewall portion defining a perimeter of the removable top plate with a beveled sidewall protrusion extending around substantially all of the sidewall portion and a plurality of recesses distributed around the bottom of the removable top plate. The home plate system further including a removable collar including a plurality of post anchors configured to releasably engage at least one of the plurality of recesses distributed around the bottom of the removable top plate and an inner groove around an inner surface of the removable collar configured to releasably engage the beveled sidewall protrusion of the removable top plate. The home plate system still further including an anchor section configured to releasably engage a bottom of the removable collar around a perimeter of the bottom of the removable collar and further to releasably engage at least one of the plurality of recesses distributed around the bottom portion of the removable top plate.

A home plate system including a removable, five-sided top plate including a top, a bottom and a sidewall portion defining a perimeter of the removable top plate with a beveled sidewall protrusion extending around substantially all of the sidewall portion and a plurality of recesses distributed around a perimeter of the bottom of the removable top plate with at least one of the recesses adjacent each corner of the top plate, at least one additional recess located between the recesses in adjacent corners, and a second at least one additional recess located adjacent a middle of the removable, five-sided top plate. The home plate system further including a removable collar including an inner flange portion with an inner perimeter of the flange portion defining an opening, and a top of the flange portion defining a bottom of a top opening into which the removable, five-sided top plate is attachable and where the plurality of upwardly protruding fasteners are spaced around the top of the flange portion to releasably engage at least one of the plurality of recesses distributed around the perimeter of the bottom of the removable top plate and an inner groove around an inner surface of the removable, five-sided collar configured to releasably engage the beveled sidewall protrusion of the removable top plate. The home plate system still further including a closed-bottom anchor section configured to releasably engage a bottom of the removable collar around a perimeter of the bottom of the removable collar and further to releasably engage the second at least one additional recess located adjacent the middle of the removable, five-sided top plate. The home plate system still further including a flexible plug configured to removably and cooperatively engage and fit into a set-up opening in the removable collar that extends downwardly through the removable collar and into the closed-bottom anchor section.

A home plate system including a removable, five-sided top plate including a top, a bottom and a sidewall portion defining a perimeter of the removable top plate with a beveled sidewall protrusion extending around substantially all of the sidewall portion and a plurality of recesses distributed around a perimeter of the bottom of the removable top plate with at least one of the recesses adjacent each corner of the top plate, at least one additional recess located between the recesses in adjacent corners, and a second at least one additional recess located adjacent a middle of the removable, five-sided top plate. The home plate system further including a removable collar including an inner flange portion with an inner perimeter of the flange portion defining an opening, and a top of the flange portion defining a bottom of a top opening into which the removable, five-sided top plate is attachable and where the plurality of upwardly protruding fasteners are spaced around the top of the flange portion to releasably engage at least one of the plurality of recesses distributed around the perimeter of the bottom of the removable top plate and an inner groove around an inner surface of the removable, five-sided collar configured to releasably engage the beveled sidewall protrusion of the removable top plate. The home plate system still further including a closed-bottom anchor section configured to releasably engage a bottom of the removable collar around a perimeter of the bottom of the removable collar and further to releasably engage the second at least one additional recess located adjacent the middle of the removable, five-sided top plate. The home plate system still further including a flexible plug configured to removably and cooperatively engage and fit into a set-up opening in the removable collar that extends downwardly through the removable collar and into the closed-bottom anchor section. The home plate system still further including a rigid setup plug configured to removably and cooperatively engage and fit into the set-up opening that extends downwardly through the removable collar and into the closed-bottom anchor section.

While the present invention has been described in conjunction with a number of embodiments, the invention is not to be limited to the description of the embodiments contained herein, but rather is defined by the claims appended hereto and their equivalents. It is further evident that many alternatives, modifications, and variations would be or are apparent to those of ordinary skill in the applicable arts. Accordingly, all such alternatives, modifications, equivalents, and variations that are within the spirit and scope of this invention.

In accordance with one or more embodiments of the present invention, a home plate system as substantially shown and described herein.

What is claimed is:

1. A home plate system comprising:

a removable top plate including a top, a bottom and a sidewall portion defining a perimeter of the removable top plate with a beveled sidewall protrusion extending around substantially all of the sidewall portion and a plurality of recesses distributed around the bottom of the removable top plate;

a removable collar including a plurality of post anchors configured to releasably engage at least one of the plurality of recesses distributed around the bottom of the removable top plate and an inner groove around an inner surface of the removable collar configured to releasably engage the beveled sidewall protrusion of the removable top plate; and an anchor section configured to releasably engage a bottom of the removable collar around a perimeter of the bottom of the removable collar and further to releasably engage at least one of the plurality of recesses distributed around the bottom portion of the removable top plate.

2. The home plate system of claim 1 wherein the removable top plate comprises five sides defining five corners with one of the plurality of recesses adjacent each corner and the perimeter of the removable top plate.

3. The home plate system of claim 2 wherein the removable top plate further comprises at least another one of the plurality of recesses spaced between adjacent pairs of the recesses in each corner around the perimeter of the removable top plate.

4. The home plate system of claim 3 wherein the removable top plate further comprises at least another one of the plurality of recesses spaced between the recesses around the perimeter of the removable top plate.

5. The home plate system of claim 1 wherein the removable top plate comprises an elastomeric material having a hardness ranging from about 40 to about 90 durometer.

6. The home plate system of claim 5 wherein the removable top plate comprises a smooth top surface.

7. The home plate system of claim 5 wherein the removable top plate comprises a grooved top surface.

8. The home plate system of claim 1 further comprising:

a flexible plug configured to removably and cooperatively engage and fit into a set-up opening in the removable collar that extends downwardly through the removable collar and partially into the anchor section.

9. The home plate system of claim 8 further comprising:

a rigid set-up pin configured to cooperatively engage the set-up opening and extend downwardly through the removable collar and into the anchor section, and partially extend above the top of the removable top plate.

10. The home plate system of claim 1 wherein the removable collar further comprises:

an up-tight bevel portion including an inner perimeter and an exterior perimeter extending around the bottom of the removable collar and the inner perimeter and defining a bottom opening to releasably engage a top portion of the anchor section;

an upright wall portion extending upwardly from and around the inner perimeter to further define the bottom opening;

a flange portion extending inwardly away from and around a top of the upright wall portion where a bottom of the flange portion defines a ledge in the bottom opening, an inner perimeter of the flange portion further defines the bottom opening, and a top of the flange portion defines a bottom of a top opening into which the removable top plate is attached and where the plurality of post anchors are spaced around the top of the flange portion; and an outer beveled portion including a beveled edge with a bottom side extending diagonally upward from and around a top exterior perimeter of the flange portion to a top side in about a middle of the top of the flange portion, the beveled edge including two substantially "V-shaped" parallel grooves extending longitudinally around the beveled edge, and a face extending downwardly from the top side of the beveled edge to the top side of the flange, the face including the inner groove.

11. The home plate system of claim 10 wherein when the removable top plate is fit within the top opening of the removable collar the removable top plate releasably engages the at least one of the plurality of recesses and the inner groove, and a slot is disposed between the face of the beveled edge on the removable collar and the sidewall of the removable top plate.

12. The home plate system of claim 1 wherein an engaged removable top plate is removed by inserting a tool in the slot between the face of the beveled edge on the removable collar and the sidewall of the removable top plate and prying-up the removable top plate.

13. The home plate system of claim 10 wherein the removable collar further comprises:

a set up plug opening defined in the beveled edge at a back corner of the removable collar and above the two substantially "V-shaped" parallel grooves.

14. The home plate system of claim 1 wherein the removable collar comprises an elastomeric material having a hardness ranging from about 40 to about 90 durometer.

15. The home plate system of claim 10 wherein the substantially "V-shaped" parallel grooves are adapted to retain soil from around an installed home plate system within each substantially "V-shaped" parallel groove.

16. The home plate system of claim 1 wherein the anchor further comprises:

a bottom portion including a five-sided solid base plate and a continuous wall extending upwardly from and around outer edges of the five-sided solid base plate, a plurality of longitudinal walls and a plurality of latitudinal walls dividing an interior space within the continuous wall into discrete sections, a raised five-sided central portion located substantially in the middle of the interior space and discrete sections, and at least one post anchor located on a top edge of at least one of the plurality of longitudinal walls and the plurality of latitudinal walls within the raised five-sided central portion.

17. The home plate system of claim 16 wherein the raised five-sided central portion is configured to fit within the opening defined by the inner perimeter of the flange portion of the removable collar.

18. The home plate system of claim 17 wherein when the raised five-sided central portion is fit within the opening defined by the inner perimeter of the flange portion of the removable collar, a top of the raised five-sided central portion is substantially level with a top of the flange portion of the removable collar.

19. The home plate system of claim 17 wherein the at least one post anchor located on a top edge of at least one of the plurality of longitudinal walls and the plurality of latitudinal walls is also located substantially adjacent a middle of the raised five-sided central portion.

20. The home plate system of claim 1 wherein the anchor comprises an elastomeric material having a hardness ranging from about 40 to about 90 durometer.

21. A home plate system comprising:

a removable, five-sided top plate including a top, a bottom and a sidewall portion defining a perimeter of the removable top plate with a beveled sidewall protrusion extending around substantially all of the sidewall portion and a plurality of recesses distributed around a perimeter of the bottom of the removable top plate with at least one of the recesses adjacent each corner of the top plate, at least one additional recess located between the recesses in adjacent corners, and a second at least one additional recess located adjacent a middle of the removable, five-sided top plate;

a removable collar including an inner flange portion with an inner perimeter of the flange portion defining an opening, and a top of the flange portion defining a bottom of a top opening into which the removable, five-sided top plate is attachable and where the plurality of upwardly protruding fasteners are spaced around the top of the flange portion to releasably engage at least one of the plurality of recesses distributed around the perimeter of the bottom of the removable top plate and an inner groove around an inner surface of the removable, five-sided collar configured to releasably engage the beveled sidewall protrusion of the removable top plate;

a closed-bottom anchor section configured to releasably engage a bottom of the removable collar around a perimeter of the bottom of the removable collar and further to releasably engage the second at least one additional recess located adjacent the middle of the removable, five-sided top plate; and a flexible plug configured to removably and cooperatively engage and fit into a set-up opening in the removable collar that extends downwardly through the removable collar and into the closed-bottom anchor section.

22. The home plate system of claim 21 wherein the removable top plate comprises five sides defining five corners with one of the plurality of recesses adjacent each corner and the perimeter of the removable top plate.

23. The home plate system of claim 22 wherein the removable top plate further comprises at least another one of the plurality of recesses spaced between adjacent pairs of the recesses in each corner around the perimeter of the removable top plate.

24. The home plate system of claim 23 wherein the removable top plate further comprises at least another one of the plurality of recesses spaced between the recesses around the perimeter of the removable top plate.

25. The home plate system of claim 21 wherein the removable, five-sided top plate, the removable collar and the closed-bottom anchor comprises an elastomeric material having a hardness ranging from about 40 to about 90 durometer.

26. The home plate system of claim 21 further comprising:

a rigid set-up pin configured to cooperatively engage the reciprocally shaped opening and extend downwardly through the removable collar and into the anchor section, and partially extend above the top of the removable top plate.

27. The home plate system of claim 21 wherein the removable collar further comprises:

an up-tight bevel portion including an inner perimeter and an exterior perimeter extending around the bottom of the removable collar and the inner perimeter and defining a bottom opening to releasably engage a top portion of the anchor section;

an upright wall portion extending upwardly from and around the inner perimeter to further define the bottom opening; and an outer beveled portion including a beveled edge with a bottom side extending diagonally upward from and around a top exterior perimeter of the flange portion to a top side in about a middle of the top of the flange portion, the beveled edge including two substantially "V-shaped" parallel grooves extending longitudinally around the beveled edge, and a face extending downwardly from the top side of the beveled edge to the top side of the flange, the face including the inner groove; and the inner flange portion extends inwardly away from and around a top of the upright wall portion where the bottom of the flange portion defines a ledge in the bottom opening, and a top of the inner flange portion defines a bottom of a top opening into which the removable top plate is attached and where the plurality of upwardly protruding fasteners are spaced around the top of the flange portion.

28. The home plate system of claim 27 wherein the substantially "V-shaped" parallel grooves are adapted to retain soil from around an installed home plate system within each substantially "V-shaped" parallel groove.

29. The home plate system of claim 21 wherein the closed-bottom anchor further comprises:

a bottom portion including a five-sided solid base plate and a continuous wall extending upwardly from and around outer edges of the five-sided solid base plate, a plurality of longitudinal walls and a plurality of latitudinal walls dividing an interior space within the continuous wall into discrete sections, a raised five-sided central portion located substantially in the middle of the interior space and discrete sections, and at least one post anchor located on a top edge of at least one of the plurality of longitudinal walls and the plurality of latitudinal walls within the raised five-sided central portion.

30. The home plate system of claim 29 wherein the raised five-sided central portion is configured to fit within the opening defined by the inner perimeter of the flange portion of the removable collar.

31. The home plate system of claim 30 wherein when the raised five-sided central portion is fit within the opening defined by the inner perimeter of the flange portion of the removable collar, a top of the raised five-sided central portion is substantially level with a top of the flange portion of the removable collar.

32. The home plate system of claim 30 wherein the at least one post anchor located on a top edge of at least one of the plurality of longitudinal walls and the plurality of latitudinal walls is also located substantially adjacent a middle of the raised five-sided central portion.

33. A home plate system comprising:

a removable, five-sided top plate including a top, a bottom and a sidewall portion defining a perimeter of the removable top plate with a beveled sidewall protrusion extending around substantially all of the sidewall portion and a plurality of recesses distributed around a perimeter of the bottom of the removable top plate with at least one of the recesses adjacent each corner of the top plate, at least one additional recess located between the recesses in adjacent corners, and a second at least one additional recess located adjacent a middle of the removable, five-sided top plate;

a removable collar including an inner flange portion with an inner perimeter of the flange portion defining an opening, and a top of the flange portion defining a bottom of a top opening into which the removable, five-sided top plate is attachable and where the plurality of upwardly protruding fasteners are spaced around the top of the flange portion to releasably engage at least one of the plurality of recesses distributed around the perimeter of the bottom of the removable top plate and an inner groove around an inner surface of the removable, five-sided collar configured to releasably engage the beveled sidewall protrusion of the removable top plate;

a closed-bottom anchor section configured to releasably engage a bottom of the removable collar around a perimeter of the bottom of the removable collar and further to releasably engage the second at least one additional recess located adjacent the middle of the removable, five-sided top plate;

a flexible plug configured to removably and cooperatively engage and fit into a set-up opening in the removable collar that extends downwardly through the removable collar and into the closed-bottom anchor section; and a rigid setup plug configured to removably and cooperatively engage and fit into the set-up opening that extends downwardly through the removable collar and into the closed-bottom anchor section.

* * * * *